US007961167B2

(12) United States Patent
Kida et al.

(10) Patent No.: US 7,961,167 B2
(45) Date of Patent: Jun. 14, 2011

(54) DISPLAY DEVICE HAVING FIRST AND SECOND VERTICAL DRIVE CIRCUITS

(75) Inventors: Yoshitoshi Kida, Kanagawa (JP); Yoshiharu Nakajima, Kanagawa (JP); Masaki Murase, Kanagawa (JP); Yoshihiko Toyoshima, Kanagawa (JP); Kazuya Nomura, Miyagi (JP); Masaaki Tonogai, Kanagawa (JP); Daisuke Ito, Kanagawa (JP)

(73) Assignee: Sony Corporation, Tokyo (JP)

( * ) Notice: Subject to any disclaimer, the term of this patent is extended or adjusted under 35 U.S.C. 154(b) by 880 days.

(21) Appl. No.: 11/298,396

(22) Filed: Dec. 8, 2005

(65) Prior Publication Data

US 2006/0139286 A1 Jun. 29, 2006

(30) Foreign Application Priority Data

Dec. 10, 2004 (JP) ..... P2004-359214

(51) Int. Cl.
*G09G 3/36* (2006.01)

(52) U.S. Cl. ..... 345/98

(58) Field of Classification Search ..... 345/87–107, 345/204, 209, 690
See application file for complete search history.

(56) References Cited

U.S. PATENT DOCUMENTS

| | | | | |
|---|---|---|---|---|
| 5,192,945 | A * | 3/1993 | Kusada | 345/100 |
| 6,067,063 | A * | 5/2000 | Kim et al. | 345/89 |
| 6,166,725 | A * | 12/2000 | Isami et al. | 345/100 |
| 6,266,041 | B1 * | 7/2001 | Cairns et al. | 345/100 |
| 6,664,943 | B1 * | 12/2003 | Nakajima et al. | 345/100 |
| 6,839,043 | B2 | 1/2005 | Nakajima | |
| 7,019,729 | B2 * | 3/2006 | Matsumoto | 345/98 |
| 7,119,770 | B2 * | 10/2006 | Moon | 345/209 |
| 2002/0030620 | A1 * | 3/2002 | Cairns et al. | 345/87 |
| 2002/0167504 | A1 * | 11/2002 | Matsumoto | 345/204 |
| 2002/0175905 | A1 * | 11/2002 | Matsumoto | 345/204 |
| 2003/0001548 | A1 | 1/2003 | Nakajima | |
| 2003/0234800 | A1 * | 12/2003 | Nakajima et al. | 345/690 |
| 2004/0227717 | A1 * | 11/2004 | Yeh | 345/100 |

FOREIGN PATENT DOCUMENTS

| | | |
|---|---|---|
| JP | 2002-175033 | 6/2002 |
| JP | 2003-131625 | 5/2003 |
| JP | 2004-226620 | 8/2004 |

OTHER PUBLICATIONS

Fujino, Hiroaki; "Driving Device for Display Device and Module of the Display Device Using the Same Drving Device", May 9, 2003. (JP 2003-131625 A; Machine Translation).*

Japanese Office Action dated Sep. 15, 2009, for corresponding Japanese Patent Application 2004-359214.

* cited by examiner

*Primary Examiner* — Chanh Nguyen
*Assistant Examiner* — Adam J Snyder
(74) *Attorney, Agent, or Firm* — K&L Gates LLP

(57) ABSTRACT

A display device and mobile terminal are provided. The display device can narrow the pitch, narrow the frame, and further reduce power consumption. The display device includes a display area; a vertical drive circuit; a first horizontal drive circuit converting input first and second digital image data to analog image signals, and supplying the same to a data line selected by the vertical drive circuit; and a second horizontal drive circuit converting input third digital image data to an analog image signal, and supplying the same to a data line selected by the vertical drive circuit. The first horizontal drive circuit includes a sampling latch circuit, a second latch circuit, a digital/analog conversion circuit, and a line selector for selecting the first and second digital image data in a time division manner in a predetermined period and outputting the same to the data line.

10 Claims, 23 Drawing Sheets

FIG. 7A VSYNC
FIG. 7B DATA (R)*6 LINES
FIG. 7C DATA (B)*6 LINES
FIG. 7D SP
FIG. 7E SAMPLING LATCH
FIG. 7F SAMPLING LATCH
FIG. 7G OERB
FIG. 7H 2nd LATCH
FIG. 7I 2nd LATCH
FIG. 7J DSELR
SSELR
FIG. 7K DSELB
SSELR
FIG. 7L SigR
FIG. 7M SigB
N-TH COLUMN
N+1-TH COLUMN
N+2-TH COLUMN
N-1-TH COLUMN
N-1-TH COLUMN OUTPUT
N-TH COLUMN OUTPUT
N+1-TH COLUMN OUTPUT

FIG. 9A VSYNC

FIG. 9B DATA (G)*6 LINES

FIG. 9C SP

FIG. 9D SAMPLING LATCH

FIG. 9E OEG

FIG. 9F 2nd LATCH

FIG. 9G SigG

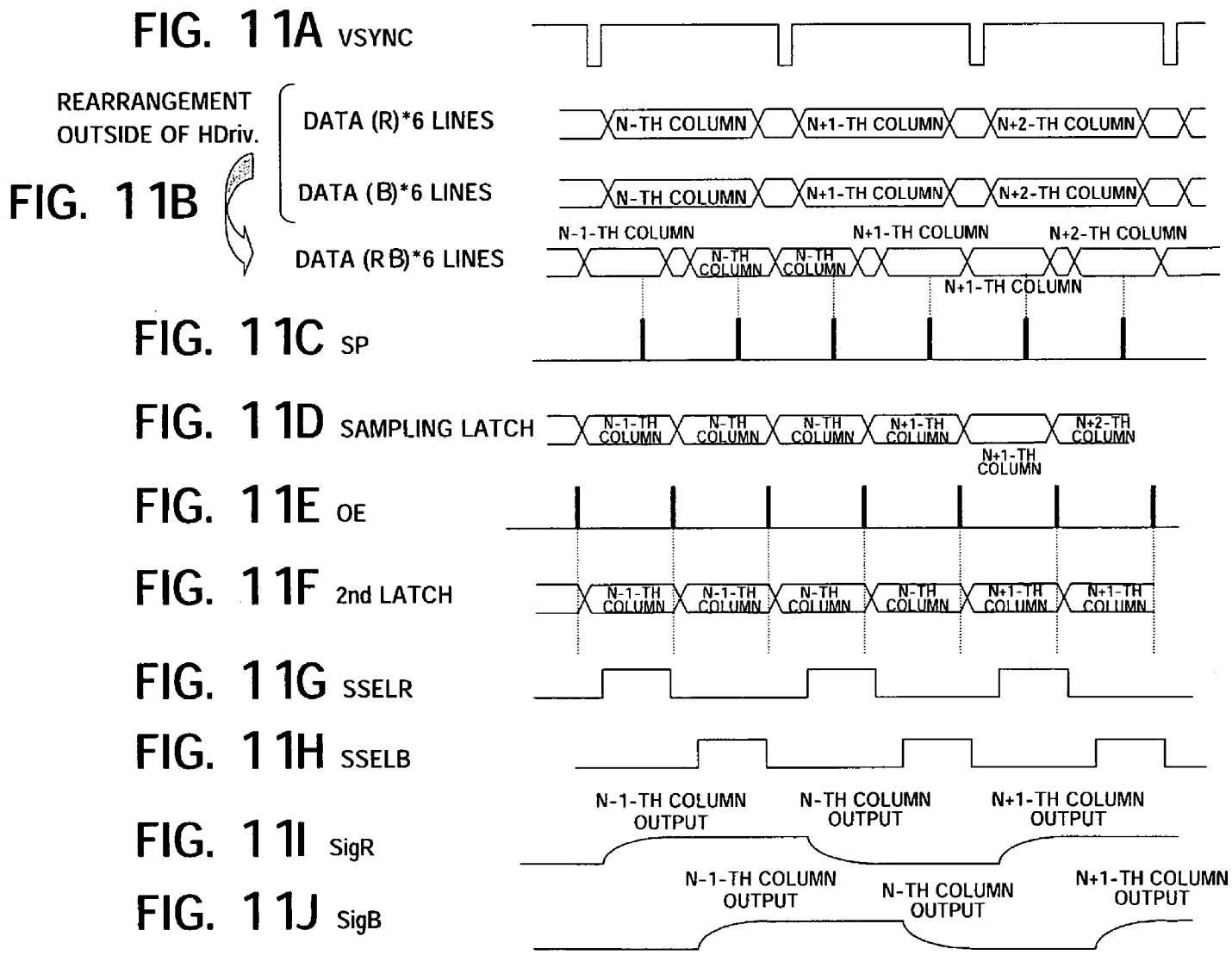
FIG. 11A VSYNC
REARRANGEMENT OUTSIDE OF HDriv.
FIG. 11B
DATA (R)*6 LINES
N-TH COLUMN
N+1-TH COLUMN
N+2-TH COLUMN
DATA (B)*6 LINES
N-TH COLUMN
N+1-TH COLUMN
N+2-TH COLUMN
DATA (RB)*6 LINES
N-1-TH COLUMN
N-TH COLUMN
N-TH COLUMN
N+1-TH COLUMN
N+2-TH COLUMN
N+1-TH COLUMN
FIG. 11C SP
FIG. 11D SAMPLING LATCH
N-1-TH COLUMN
N-TH COLUMN
N-TH COLUMN
N+1-TH COLUMN
N+2-TH COLUMN
N+1-TH COLUMN
FIG. 11E OE
FIG. 11F 2nd LATCH
N-1-TH COLUMN
N-1-TH COLUMN
N-TH COLUMN
N-TH COLUMN
N+1-TH COLUMN
N+1-TH COLUMN
FIG. 11G SSELR
FIG. 11H SSELB
FIG. 11I SigR
N-1-TH COLUMN OUTPUT
N-TH COLUMN OUTPUT
N+1-TH COLUMN OUTPUT
FIG. 11J SigB
N-1-TH COLUMN OUTPUT
N-TH COLUMN OUTPUT
N+1-TH COLUMN OUTPUT

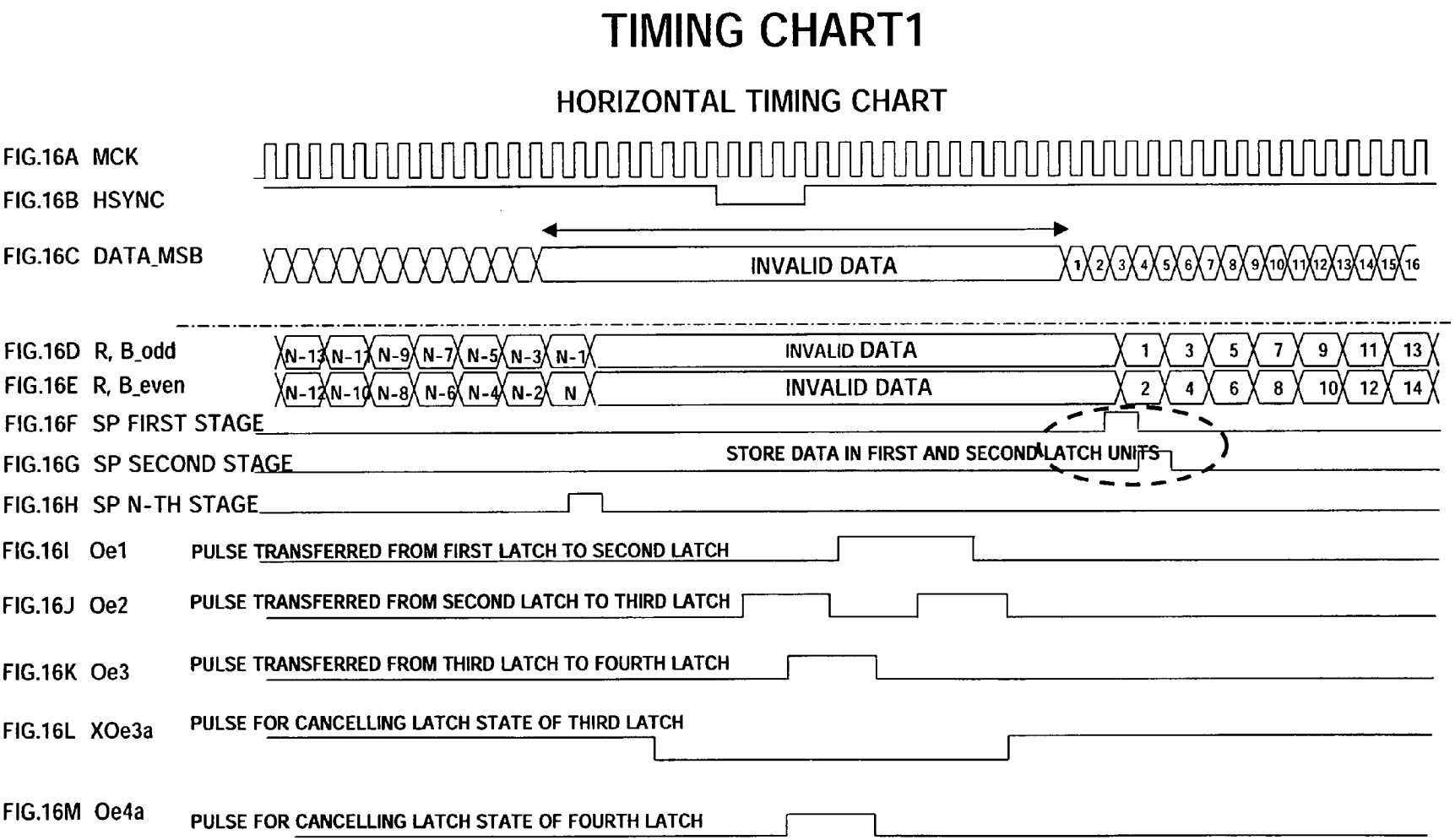
TIMING CHART1
HORIZONTAL TIMING CHART
FIG.16A MCK
FIG.16B HSYNC
FIG.16C DATA_MSB
FIG.16D R, B_odd
FIG.16E R, B_even
FIG.16F SP FIRST STAGE
FIG.16G SP SECOND STAGE
FIG.16H SP N-TH STAGE
FIG.16I Oe1
FIG.16J Oe2
FIG.16K Oe3
FIG.16L XOe3a
FIG.16M Oe4a
INVALID DATA
INVALID DATA
INVALID DATA
STORE DATA IN FIRST AND SECOND LATCH UNITS
PULSE TRANSFERRED FROM FIRST LATCH TO SECOND LATCH
PULSE TRANSFERRED FROM SECOND LATCH TO THIRD LATCH
PULSE TRANSFERRED FROM THIRD LATCH TO FOURTH LATCH
PULSE FOR CANCELLING LATCH STATE OF THIRD LATCH
PULSE FOR CANCELLING LATCH STATE OF FOURTH LATCH

TIMING CHART2
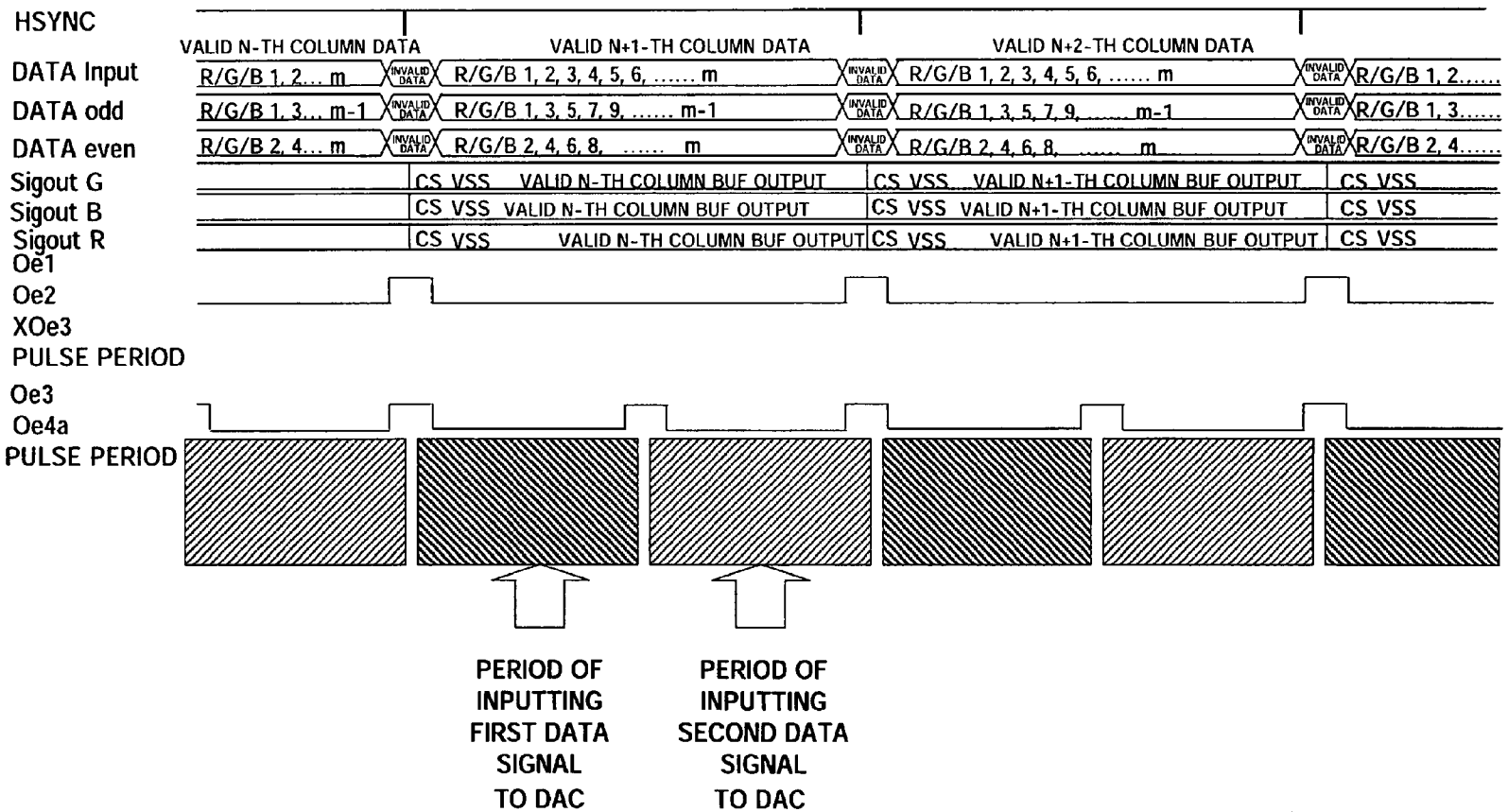

TIMING CHART3
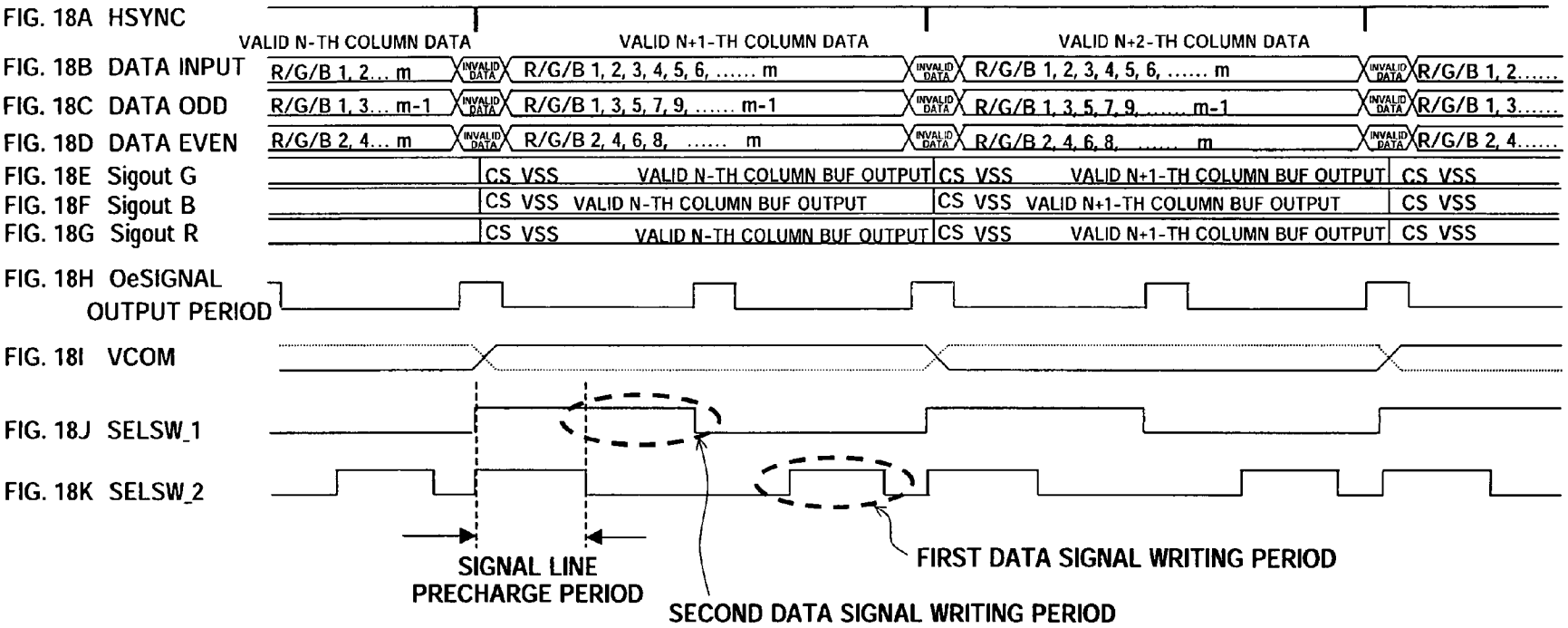

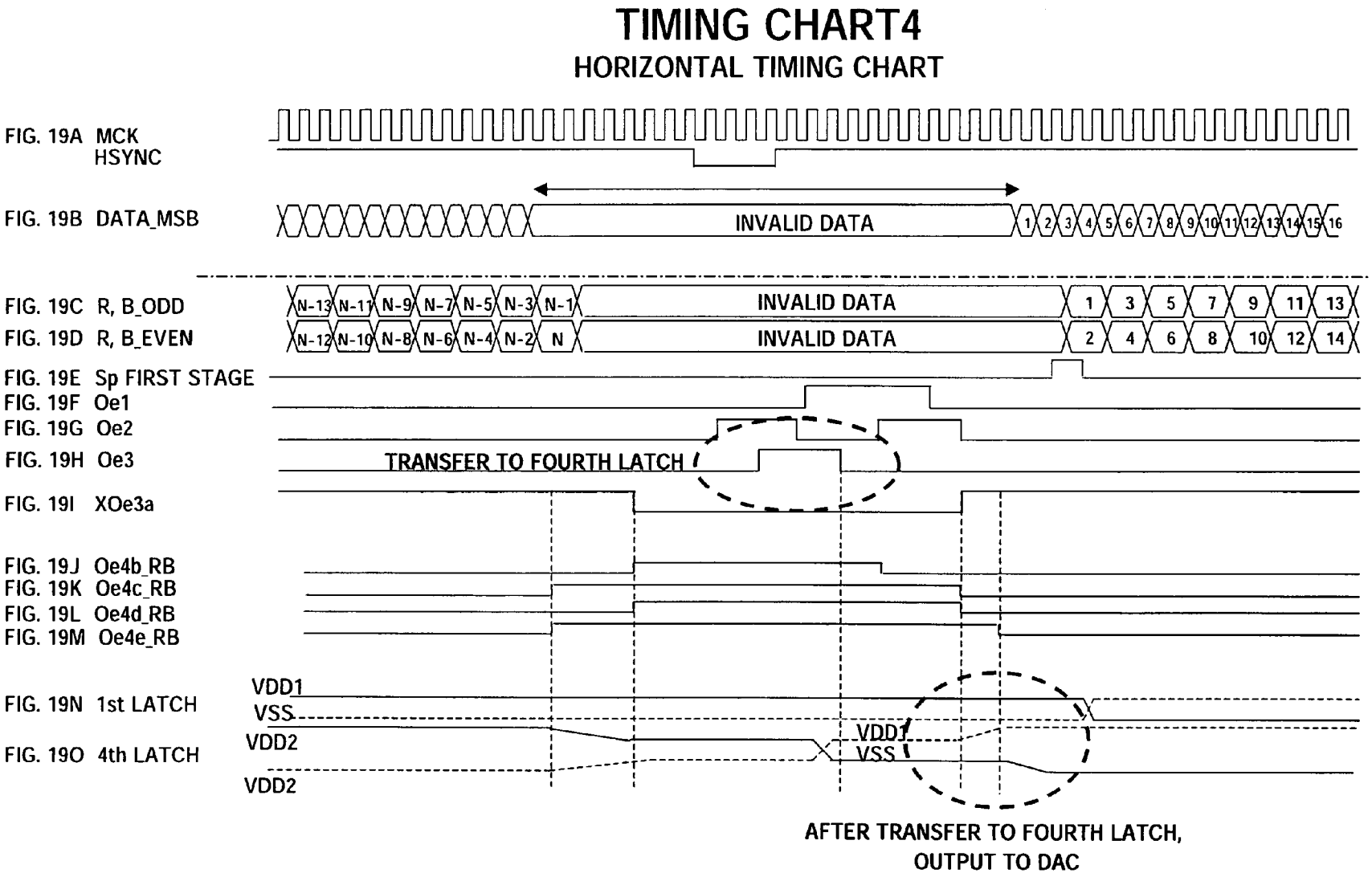
TIMING CHART4
HORIZONTAL TIMING CHART
FIG. 19A MCK
HSYNC
FIG. 19B DATA_MSB
FIG. 19C R, B_ODD
FIG. 19D R, B_EVEN
FIG. 19E Sp FIRST STAGE
FIG. 19F Oe1
FIG. 19G Oe2
FIG. 19H Oe3
FIG. 19I XOe3a
FIG. 19J Oe4b_RB
FIG. 19K Oe4c_RB
FIG. 19L Oe4d_RB
FIG. 19M Oe4e_RB
FIG. 19N 1st LATCH
FIG. 19O 4th LATCH
INVALID DATA
INVALID DATA
INVALID DATA
TRANSFER TO FOURTH LATCH
VDD1
VSS
VDD2
VDD2
VDD1
VSS
AFTER TRANSFER TO FOURTH LATCH,
OUTPUT TO DAC

DISPLAY DEVICE HAVING FIRST AND SECOND VERTICAL DRIVE CIRCUITS

CROSS REFERENCES TO RELATED APPLICATIONS

The present application claims priority to Japanese Patent Application No. 2004-359214 filed in the Japan Patent Office on Dec. 10, 2004, the entire contents of which is being incorporated herein by reference.

BACKGROUND

The present invention relates a liquid crystal display device or other active matrix type display device and a mobile terminal using the same.

In recent years, mobile phones, personal digital assistants (PDAs), and other mobile terminals have rapidly spread in use. One of the factors behind the rapid spread of these mobile terminals has been the liquid crystal display devices provided as the display areas of their outputs. The reason is that liquid crystal display devices are displays by nature not in principle requiring power for being driven and therefore having a low power consumption.

In recent years, active matrix type display devices using polysilicon thin film transistors (TFTs) as switching elements of pixels have had digital interface drive circuits formed integrally on the same substrates as display areas comprised of pixels arranged in a matrix. In such an integral drive circuit type display device, a horizontal drive system and a vertical drive system are arranged at the periphery (frame) of the active display area. These drive systems are integrally formed on the same substrate together with the pixel area by using polysilicon TFTs.

FIG. 1 is a diagram showing the schematic configuration of a general integral drive circuit type display device (see for example Japanese Unexamined Patent Publication (Kokai) No. 2002-175033).

This liquid crystal display device, as shown in FIG. 1, is comprised of a transparent insulating substrate, for example, a glass substrate 1, on which an active display area 2 comprised of a plurality of pixels including liquid crystal cells arranged in a matrix, a pair of horizontal drive circuits (H drivers) 3U and 3D arranged above and below the active display area 2 in FIG. 1, a vertical drive circuit (V driver) 4 arranged at a side part of the active display area 1 in FIG. 1, one reference voltage generation circuit 5 for generating a plurality of reference voltages, and a data processing circuit 6 are formed.

In this way, the integral drive circuit type display device of FIG. 1 has two horizontal drive circuits 3U and 3D arranged at both sides of the active display area 2 (above and below in FIG. 1). This is for driving the display while dividing data lines to odd number lines and even number lines.

FIG. 2 is a block diagram showing an example of the configuration of the horizontal drive circuits 3U and 3D of FIG. 1 for separately driving the odd number lines and the even number lines.

As shown in FIG. 2, the horizontal drive circuit 3U for driving the odd number lines and the horizontal drive circuit 3D for driving the even number lines have the same configuration. Specifically, they have shift register (HSR) groups 3HSRU and 3HSRD for sequentially outputting shift pulses (sampling pulses) from transfer stages in synchronization with a horizontal transfer clock HCK (not shown), sampling latch circuit groups 3SMPLU and 3SMPLD for sequentially sampling and latching digital image data by sampling pulses given from shift registers 31U and 31D, line sequence latch circuit groups 3LTCU and 3LTCD for arranging latch data of the sampling latch circuits 32U and 32D in line sequence, and digital/analog conversion circuit (DAC) groups 3DACU and 3DACD for converting the digital image data arranged in line sequence in the line sequence latch circuits 33U and 33D to analog image signals. Note that, usually, level shift circuits are arranged at input stages of the DACs 34U and 34D and level upped data are input to the DACs 34U and 34D.

As shown in FIG. 2, the horizontal drive circuits 3U and 3D of FIG. 1 have sampling latch circuits 32, line sequence latch circuits 33, and DACs 34 arranged for each odd number data line and even number data line to be driven.

Further, in mobile phones and other mobile terminals, there has been increasingly stronger demand for lowering the power consumption of the display device along with their rapid spread. Particularly, the reduction of the power consumption in the standby period has become an important point in increasing the battery life, so has become a particularly strong requirements. A variety of power saving technologies have been proposed for this requirement. As one of them, the so-called "1 bit mode" (2 gradation mode) of restricting the number of gradation of the image display to "2" (1 bit) for each color at the time of standby is known. In this 1 bit mode, gradations are expressed by 1 bit per color, therefore images are displayed by a total of eight colors.

However, in the horizontal drive circuit of FIG. 2 explained above, one data line requires 1 set of a sampling latch circuit 32, line sequence latch circuit 33, and DAC 34, therefore the lateral width permitted in terms of layout is small. For this reason, reduction of the pitch is impossible. Further, there is the disadvantage that the number of required circuits is large, therefore the frame becomes large. In the case of the horizontal drive circuits of FIG. 2, three sampling latch circuits for sampling serial/parallel converted R (red), G (green), and B (blue) data are required. With this, it is difficult to meet the demands for narrower pitch and narrower frame. In order to overcome this, it can be also considered to extend the layout in the vertical direction, but this abruptly increases the layout area and makes realization of a narrower frame difficult.

Further, as the DACs, ones of the reference voltage selection type are employed, but the same color is divided vertically by even number columns and odd number columns. Therefore, unless the output potentials of the reference voltage generation circuits 15 are made the same, vertical stripes etc. will be generated, so it is necessary to connect reference voltage lines RVL of the DACs 34U and 34D of the two horizontal drive circuits 3U and 3D. For this reason, an increase of the frame in the lateral direction in FIG. 1 is induced.

Further, in a display device having an 8 color mode (low gradation mode), usually two DACs, one for the normal mode and one for the 8 color mode, are provided. The two DACs, however, shared the sampling latch circuit and the line sequential alignment circuit. Both at the time of the normal mode and at the time of the 8 color mode, the level was converted, then the data was input to the DACs. For this reason, there were the following disadvantages. At the time of the 8 color mode as well, the DAC input signal is made large in amplitude, therefore the charged/discharged current is large and the power consumption is high. Further, the higher bit and lower bit level shifter circuits are separately processed, therefore the circuit of the latch portion becomes large, and the frame becomes large.

SUMMARY

It is therefore desirable to provide a display device able to realize a narrower frame and able to further lower the power consumption and a mobile terminal using the same.

According to a first aspect of an embodiment of the present invention, there is provided a display device comprising a display area having pixels arranged in a matrix; a vertical drive circuit for selecting pixels in the display area in units of rows; a first horizontal drive circuit receiving as input first and second digital image data, converting the digital image data to analog image signals, and supplying the same to a data line to which pixels of the row selected by the vertical drive circuit are connected; and a second horizontal drive circuit receiving as input third digital image data, converting the digital image data to an analog image signal, and supplying the same to a data line to which pixels of the row selected by the vertical drive circuit are connected, wherein the first horizontal drive circuit includes a sampling latch circuit for sequentially sampling and latching the first and second digital image data, a second latch circuit for latching the latch data of the sampling latch circuit again, a digital/analog conversion circuit (DAC) for converting the digital image data latched by the second latch circuit to an analog image signal, and a line selector for selecting the first and second digital image data converted to analog data by the DAC in a time division manner in a predetermined period and outputting the same to the data line.

Preferably, the second latch circuit arranges the latch data in line sequence in the sampling latch circuit, and the first horizontal drive circuit further has a data selector for selecting the first and second digital image data latched at the second latch circuit in a time division manner in the predetermined period and inputting the same to the DAC.

Preferably, the second horizontal drive circuit includes a sampling latch circuit for sequentially sampling and latching third digital image data, a second latch circuit for latching the latch data of the sampling latch circuit again, and a digital/analog conversion circuit (DAC) for converting the digital image data latched by the second latch circuit to an analog image signal, and DACs of the first and second horizontal drive circuits further the device has a first reference voltage generation circuit for generating a plurality of reference voltages and supplying the same to the DAC of the first horizontal drive circuit and a second reference voltage generation circuit for generating a plurality of reference voltages and supplying the same to the DAC of the second horizontal drive circuit.

Preferably, at least the first and second horizontal drive circuits are formed integrally with an active pixel area on the same substrate.

Preferably, at least the first and second horizontal drive circuits and the first and second reference voltage generation circuits are formed integrally with the active pixel area on the same substrate.

Preferably, the sampling latch circuits and the second latch circuits of the first and second horizontal drive circuits perform data transfer and holding operations by the first power supply voltage system, data shifted to a second power supply voltage system larger than a first power supply voltage is input to the DACs, the first and second horizontal drive circuits have n-bit DACs used in the normal mode and n data signal lines for controlling them and independently have k-bit DACs able to use and control k (n>k) data signal lines among n data signal lines, which of the n-bit DAC or the k-bit DAC is to be used is controlled by a mode selection signal, and control is performed so that in the normal mode, the n-bit DAC is used and the level is converted to a second power supply voltage system having a larger voltage amplitude than a first power supply voltage system having a small signal amplitude and input to the n-bit DAC circuit and so that at the time of a low gradation mode having a smaller number of gradations than that in the normal mode, the k-bit DAC is used and a signal having the small signal amplitude is input to the k-bit DAC circuit as it is.

According to a second aspect of an embodiment of the present invention, there is provided a display device comprising a display area having pixels arranged in a matrix; a vertical drive circuit for selecting pixels in the display area in unit of rows; a first horizontal drive circuit receiving as input first and second digital image data, converting the digital image data to analog image signals, and supplying the same to a data line to which pixels of the row selected by the vertical drive circuit are connected; and a second horizontal drive circuit receiving as input a third digital image data, converting the digital image data to analog image signals, and supplying the same to a data line to which pixels of the row selected by the vertical drive circuit are connected, wherein the first horizontal drive circuit includes a first sampling latch for sequentially sampling and latching the first digital image data, a second sampling latch for sequentially sampling and latching the second digital image data, an output circuit for selecting the first and second digital image data latched in the first and second sampling latches in a time division manner in a predetermined period and outputting the same, a digital/analog conversion circuit (DAC) for converting the first and second digital image data output from the output circuit to analog image signals, and a line selector for selecting the first and second digital image data converted to analog data by the DAC in a time division manner in the predetermined period and outputting the same to a data line.

Preferably, the first and second sampling latches are cascade connected, the output circuit includes a third latch and a fourth latch cascade connected to the output of the second sampling latch, the first and second sampling latches store the first digital image data and second digital image data by the same sampling pulse, and the output circuit transfers the second digital image data of the second sampling latch through the third latch to the fourth latch and then transfers the first digital image data of the first sampling latch through the second sampling latch to the third latch.

Preferably, the output circuit transfers the second digital image data to the DAC in the former half of a horizontal period after the above operation, and next, transfers the first digital image data from the third latch to the fourth latch after the end of the former half of the horizontal period, and transfers the same to the DAC in the latter half period of the horizontal period.

Preferably, the first sampling latch, the second sampling latch, and the third latch perform the transfer and holding operations by a first power supply voltage, and the fourth latch changes the power supply voltage to a second voltage corresponding to the DAC in the next stage and performs the holding and signal output operations after completion of a write operation into the itself.

According to a third aspect of an embodiment of the present invention, there is provided a mobile terminal provided with a display device, wherein the display device has a display area having pixels arranged in a matrix, a vertical drive circuit for selecting pixels in the display area in unit of rows, a first horizontal drive circuit receiving as input first and second digital image data, converting the digital image data to analog image signals, and supplying the same to a data line to which pixels of the row selected by the vertical drive circuit are connected, and a second horizontal drive circuit receiving as input a third digital image data, converting the digital image data to an analog image signal, and supplying the same to a data line to which pixels of the row selected by the vertical drive circuit are connected, wherein the first horizontal drive circuit includes a sampling latch circuit for sequentially sampling and latching the first and second digital image data, a second latch circuit for latching the latch data of the sampling latch circuit again, a digital/analog conversion circuit (DAC) for converting the digital image data latched by the second latch circuit to an analog image signal, and a line selector for selecting the first and second digital image data converted to analog data by the DACs in a time division manner in a predetermined period and outputting the same to the data line.

According to a fourth aspect of an embodiment of the present invention, there is provided a mobile terminal provided with a display device, wherein the display device has a display area having pixels arranged in a matrix, a vertical drive circuit for selecting pixels in the display area in unit of rows, a first horizontal drive circuit receiving as input first and second digital image data, converting the digital image data to analog image signals, and supplying the same to a data line to which pixels of the row selected by the vertical drive circuit are connected, and a second horizontal drive circuit receiving as input a third digital image data, converting the digital image data to an analog image signal, and supplying the same to a data line to which pixels of the row selected by the vertical drive circuit are connected, wherein the first horizontal drive circuit includes a first sampling latch for sequentially sampling and latching the first digital image data, a second sampling latch for sequentially sampling and latching the second digital image data, an output circuit for selecting the first and second digital image data latched in the first and second sampling latches in a time division manner in a predetermined period and outputting the same, a digital/analog conversion circuit (DAC) for converting the first and second digital image data output from the output circuit to analog image signals, and a line selector for selecting the first and second digital image data converted to analog data by the DAC in a time division manner in a predetermined period and outputting the same to the data line.

According to the embodiment of the present invention, for example two horizontal drive circuits are arranged on the two sides of the active pixel area. This is not for driving the system while dividing the data lines into odd number lines and even number lines, but for dividing them for each color, for example, serially driving the data lines in response to R data and B data by for example the first horizontal drive circuit and driving the data lines in response to G data by the second horizontal drive circuit. At the time of the serial drive operation, a time series drive (time division drive) operation is carried out so that one data between two digital data, for example, the R data, is output in a predetermined period, for example ½ of the former half of one horizontal period (1 H), and the other B data is output in ½ of the latter half of 1 H.

According to the embodiment of the present invention, an integral drive circuit type display device able to handle high precision with a narrow frame and consuming a low power can be realized.

Additional features and advantages are described herein, and will be apparent from, the following Detailed Description and the figures.

BRIEF DESCRIPTION OF THE FIGURES

FIGS. 11A-11J illustrate a timing chart of the first horizontal drive circuit of FIG. 10.

FIGS. 16A-16M illustrate a timing chart showing operations of storing a first data signal group (R data or B data) in a first latch group and storing a second data signal group (B data or R data) in a second latch group by the same sampling pulse SP, then first transferring the second data signal group to a fourth latch group, then transferring the first data signal group to a third latch group in the first horizontal drive circuit according to the second embodiment.

FIGS. 17A-17J illustrate a timing chart showing operations of transferring the second data signal group to a DAC in a former half of a horizontal period, then transferring the first data signal from the third latch group to the fourth latch group after the end of the former half of the horizontal period and transferring the same to the DAC in the period of a latter half of the horizontal period in the first horizontal drive circuit according to the second embodiment.

FIGS. 18A-18K illustrate a timing chart of the operation of distributing signals to the data line corresponding to the first data signal and the data line corresponding to the second data signal in the active display area in a time sequence via the data selector group in the first horizontal drive circuit according to the second embodiment.

FIGS. 19A-19O is a timing chart in which the first latch to the third latch perform transfer and holding operations by a first power supply voltage VDD1 (VSS) and a fourth latch changes the power supply voltage to second voltages VH and VL corresponding to the DAC in the next stage after completion of write operation to itself and performs the holding and signal output operations in the first horizontal drive circuit according to the second embodiment.

DETAILED DESCRIPTION

Below, embodiments of the present invention will be explained in detail with reference to the drawings.

First Embodiment

Figure 3:
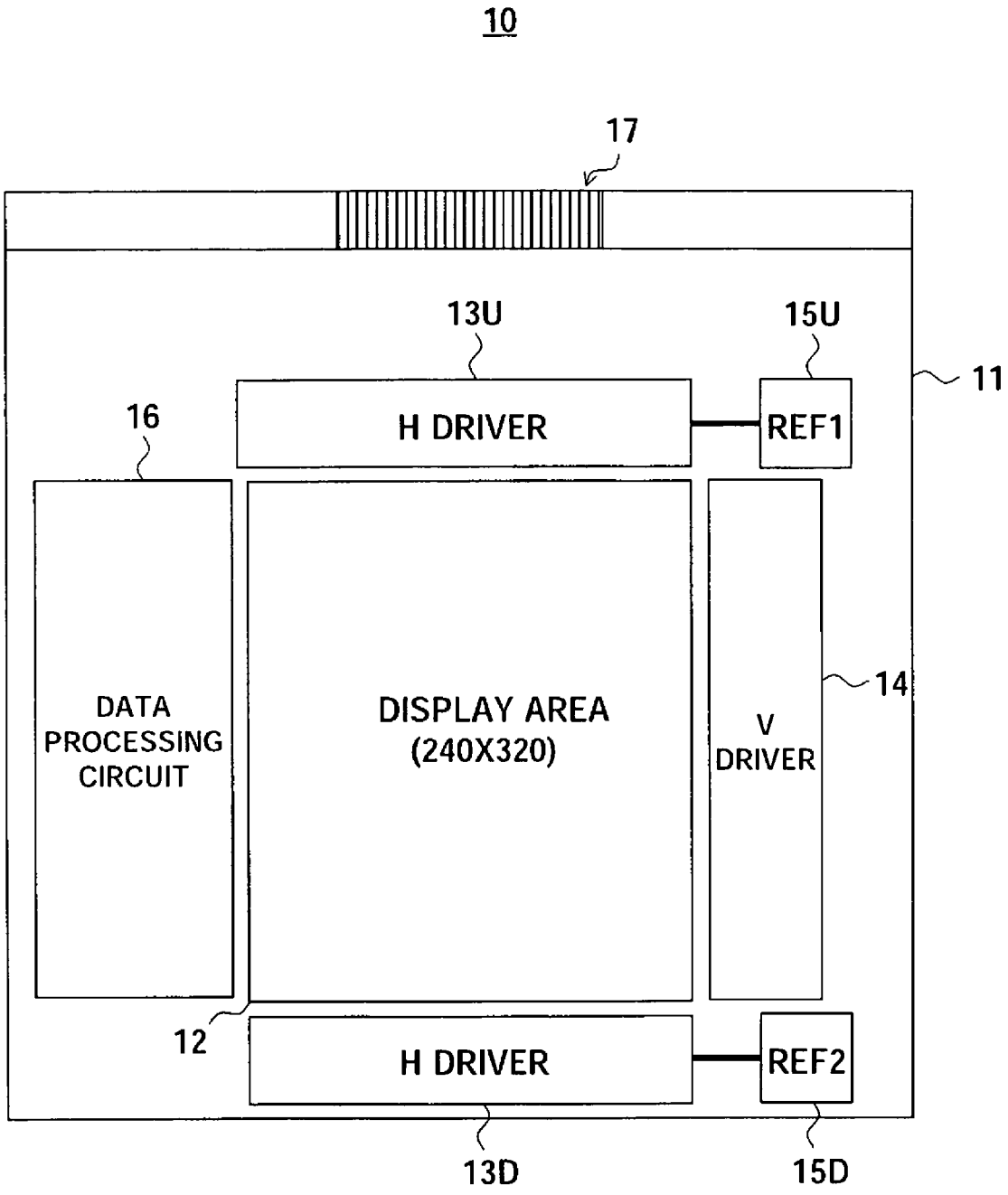
FIG. 3 is a diagram showing the schematic configuration of an integral drive circuit type display device according to a first embodiment of the present invention.

FIG. 3 is a schematic view of an example of the configuration of an integral drive circuit type display device according to a first embodiment of the present invention. Here, for example the explanation will be given by taking as an example a case of applying the present invention to an active matrix type liquid crystal display device using liquid crystal cells as electro-optical elements of the pixels.

Figure 1:
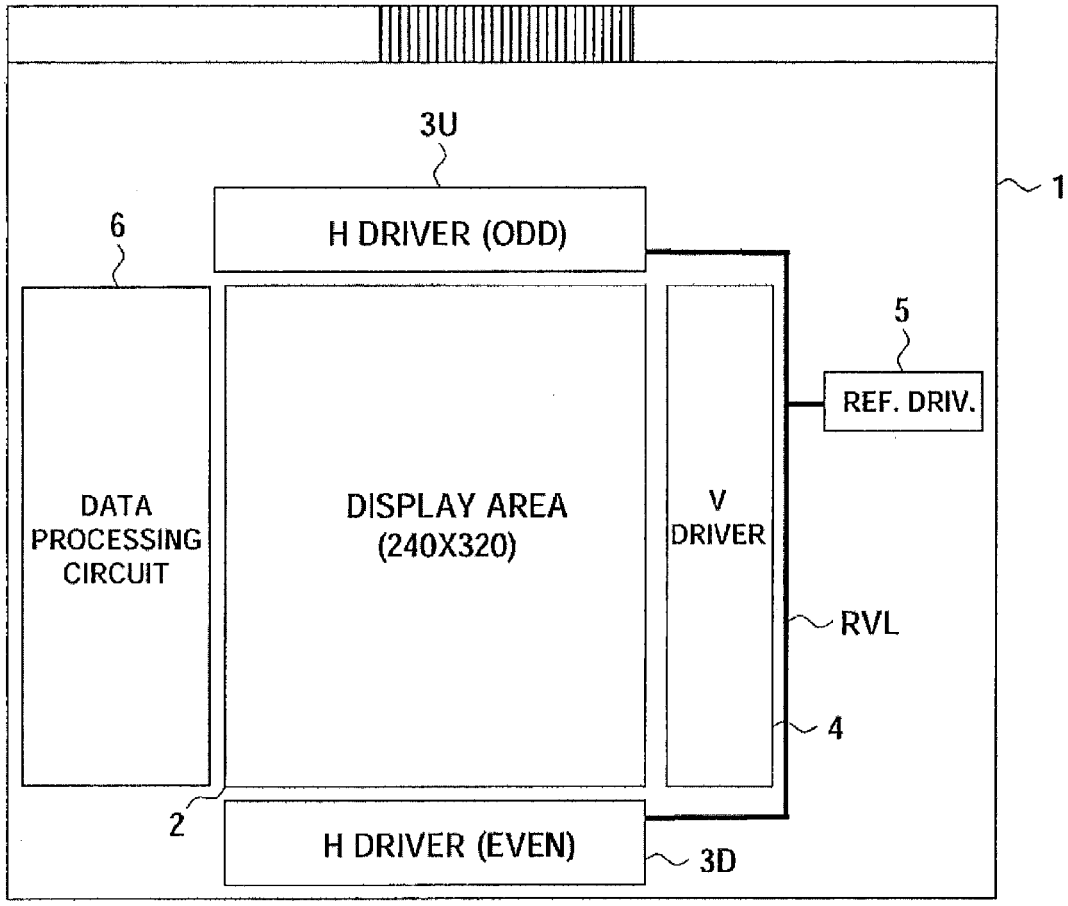
FIG. 1 PRIOR ART
FIG. 1 is a diagram showing the schematic configuration of a past integral drive circuit type display device.
Figure 2:
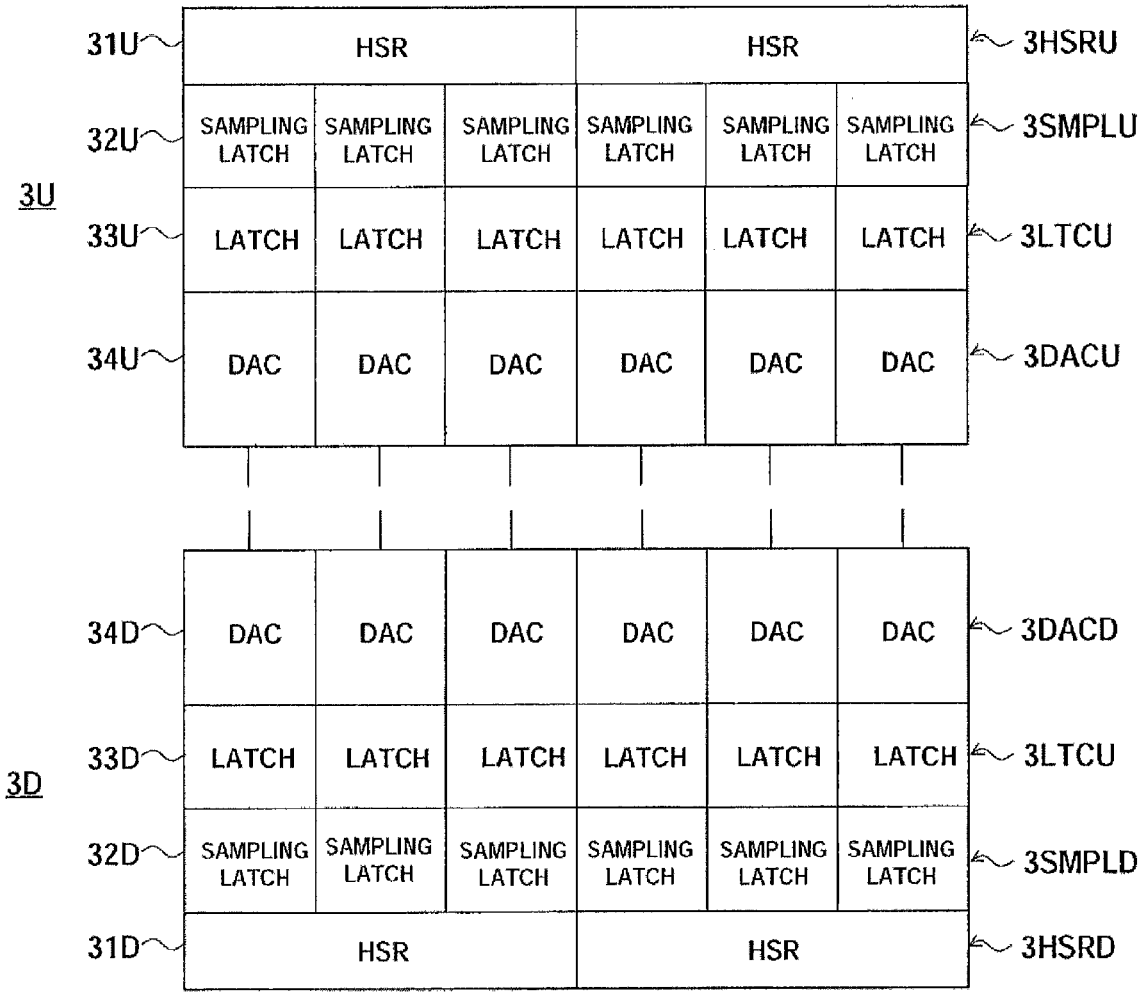
FIG. 2 PRIOR ART
FIG. 2 is a block diagram showing an example of the configuration of a horizontal drive circuit of FIG. 1 for separately driving odd number lines and even number lines.

This liquid crystal display device 10, as shown in FIG. 3, is comprised of a transparent insulating substrate, for example, a glass substrate 11 on which an active display area (active pixel area) 12 having a plurality of pixels including liquid crystal cells arranged in a matrix, first and second horizontal drive circuits (H drivers) 13U and 13D arranged above and below the active display area 12 in FIG. 3, a vertical drive circuit (V driver) 14 arranged at a side part of the active display area 2 in FIG. 1, first and second reference voltage generation circuits 15U and 15D for generating a plurality of reference voltages, and a data processing circuit 16 are formed. Further, an input pad 17 for data etc. is formed at an edge portion in the vicinity of the position of arrangement of the second horizontal drive circuit 13U of the glass substrate 11. The glass substrate 11 is constituted by a first substrate on which a plurality of pixel circuits including active elements (for example transistors) are formed in a matrix and a second substrate arranged facing this first substrate with a predetermined clearance. Liquid crystals are sealed between these first and second substrates.

The integral drive circuit type liquid crystal display device 10 of the present embodiment arranges the two horizontal drive circuits 13U and 13D at the two sides (above and below in FIG. 3) of the active display (pixel) area 12. This is not for driving the system while dividing data lines to odd number lines and even number lines, but for dividing them for each color, for example, serially driving the data lines in response to R data and the B data by the first horizontal drive circuit 13U and driving the data lines in response to the G data by the second horizontal drive circuit 13D. In the present embodiment, "serially driving" means driving by time series (time division) so that one data between two digital data, for example the R data, is output in ½ of the foemer (first) half of 1 horizontal period (1 H), and the other B data is output in ½ of the latter half of 1 H.

Since the three color data are driven divided by the two horizontal drive circuits 13U and 13D, even if individually providing reference voltage generation circuits corresponding to the horizontal drive circuits 13U and 13D, the problem of image quality such as vertical stripes will not occur. Therefore, in the present embodiment, reference voltage generation circuits 15U and 15D corresponding to the drive circuits are arranged close to the horizontal drive circuits 13U and 13D. These first and second reference voltage generation circuits 15U and 15D are not connected by a power supply line such as a reference voltage line.

Below, the configurations and functions of components of the liquid crystal display device 10 of the present embodiment will be explained in sequence.

The active display area 12 has a plurality of pixels including liquid crystal cells arranged in a matrix. Further, the active display area 12 has data lines and vertical scanning lines driven by the horizontal drive circuits 13U and 13D and the vertical drive circuit 14 arranged in a matrix.

Figure 4:
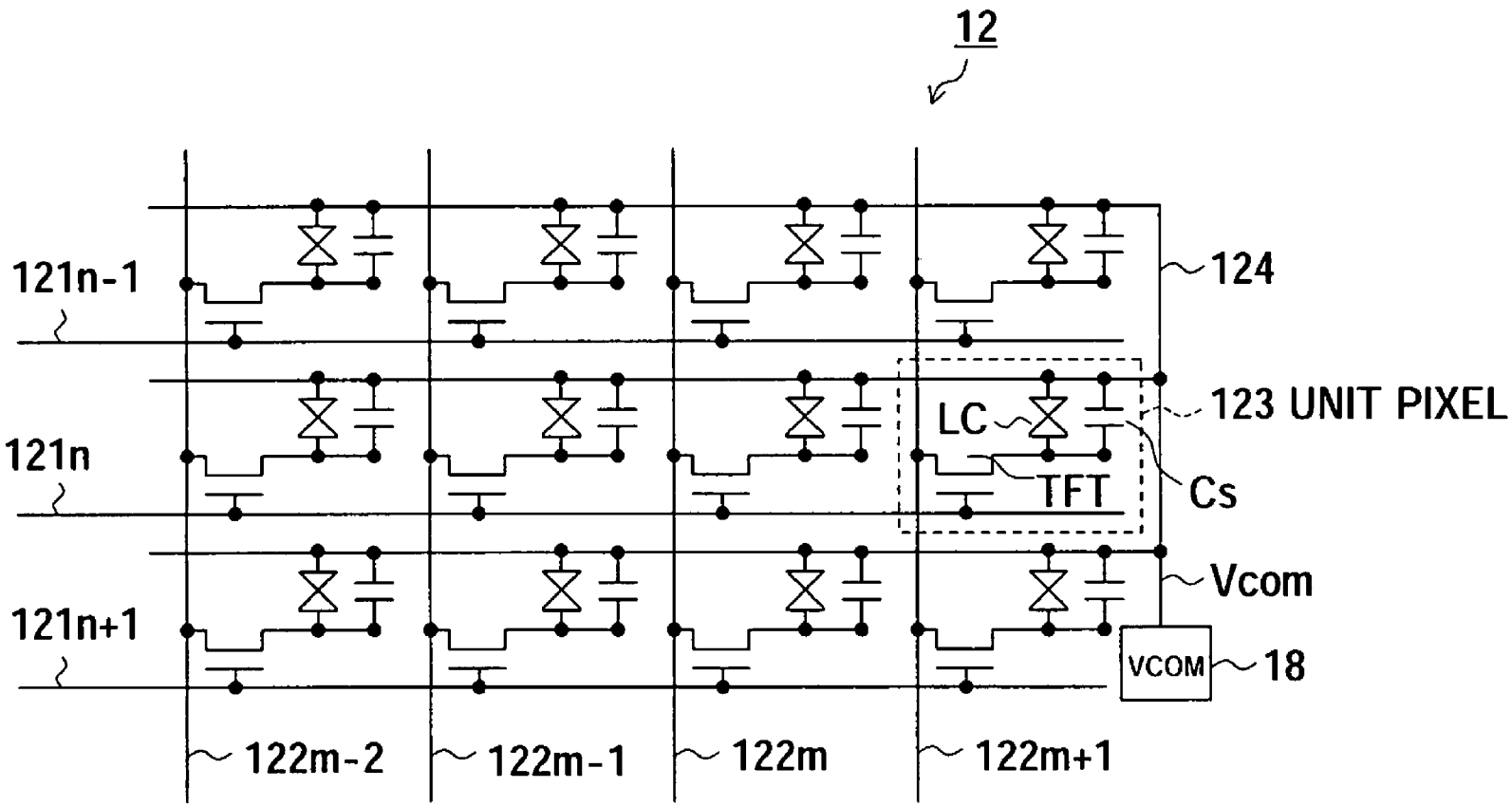
FIG. 4 is a circuit diagram showing an example of the configuration of an active display area of a liquid crystal display device.

FIG. 4 is a diagram showing an example of a specific configuration of the active display area 12. Here, for simplification of the drawing, a case of a pixel array of 3 rows (n−1 row to n+1 row) and 4 columns (m−2 column to m+1 column) is shown as an example. In FIG. 4, the active display area 12 has vertical scan lines . . . , 121$n$−1, 121$n$, 121$n$+1, . . . , and data lines . . . , 122$m$−2, 122$m$−1, 12$m$, 122$m$+1, . . . , arranged in a matrix and has unit pixels 123 arranged at intersecting portions of the same.

Each unit pixel 123 is configured having a pixel transistor constituted by a thin film transistor TFT, a liquid crystal cell LC, and a storage capacitor Cs. Here, the liquid crystal cell LC means a capacitance generated between a pixel electrode (one electrode) formed by the thin film transistor TFT and a counter electrode (other electrode) formed facing this.

The thin film transistor TFT is connected at its gate electrode to the vertical scan lines . . . , 121$n$−1, 121$n$, 121$n$+1, . . . and is connected at its source electrode to the data lines . . . , 122$m$−2, 122$m$−1, 122$m$, 122$m$+1 . . . . The liquid crystal cell LC is connected at its pixel electrode to the drain electrode of the thin film transistor TFT and is connected at its counter electrode to a common line 124. The storage capacitor Cs is connected between the drain electrode of the thin film transistor TFT and the common line 124. The common line 124 is given a predetermined alternating voltage (AC voltage) as a common voltage Vcom by a VCOM circuit 18 formed integrally with the drive circuit etc. on the glass substrate 11.

First ends of the vertical scan lines . . . , 121$n$−1, 121$n$, 121$n$+1, . . . are connected to output ends of the corresponding rows of the vertical drive circuit 14 shown in FIG. 3. The vertical drive circuit 14 is configured by for example a shift register and sequentially generates vertical selection pulses in synchronization with a vertical transfer clock VCK (not shown) and gives the same to the vertical scan lines . . . , 121$n$−1, 121$n$, 121$n$+1, . . . for the vertical scan.

Further, in the active display area 12, for example, first ends of the data lines . . . , 122$m$−2, 122$m$−1, 122$m$, 122$m$+1, . . . are connected to the output ends of the corresponding columns of the first horizontal drive circuit 13U shown in FIG. 3, while the other ends are connected to the output ends of the corresponding columns of the second horizontal drive circuit 13D.

The first horizontal drive circuit 13U serially drives the data lines in accordance with the R data and the B data, while the second horizontal drive circuit 13D drives the data lines in accordance with the G data. The first horizontal drive circuit 13U drives them so that one data between two digital data, for example the R data, is output in ½ of the former (first) half of one horizontal period (1 H), and the other B data is output in ½ of the latter half of 1 H along with the serial drive. Accordingly, in the present embodiment, the first horizontal drive circuit 13U for the R data and B data performing the serial drive and the second horizontal drive circuit 13D for the G data not performing the serial drive have different configurations.

Figure 5:
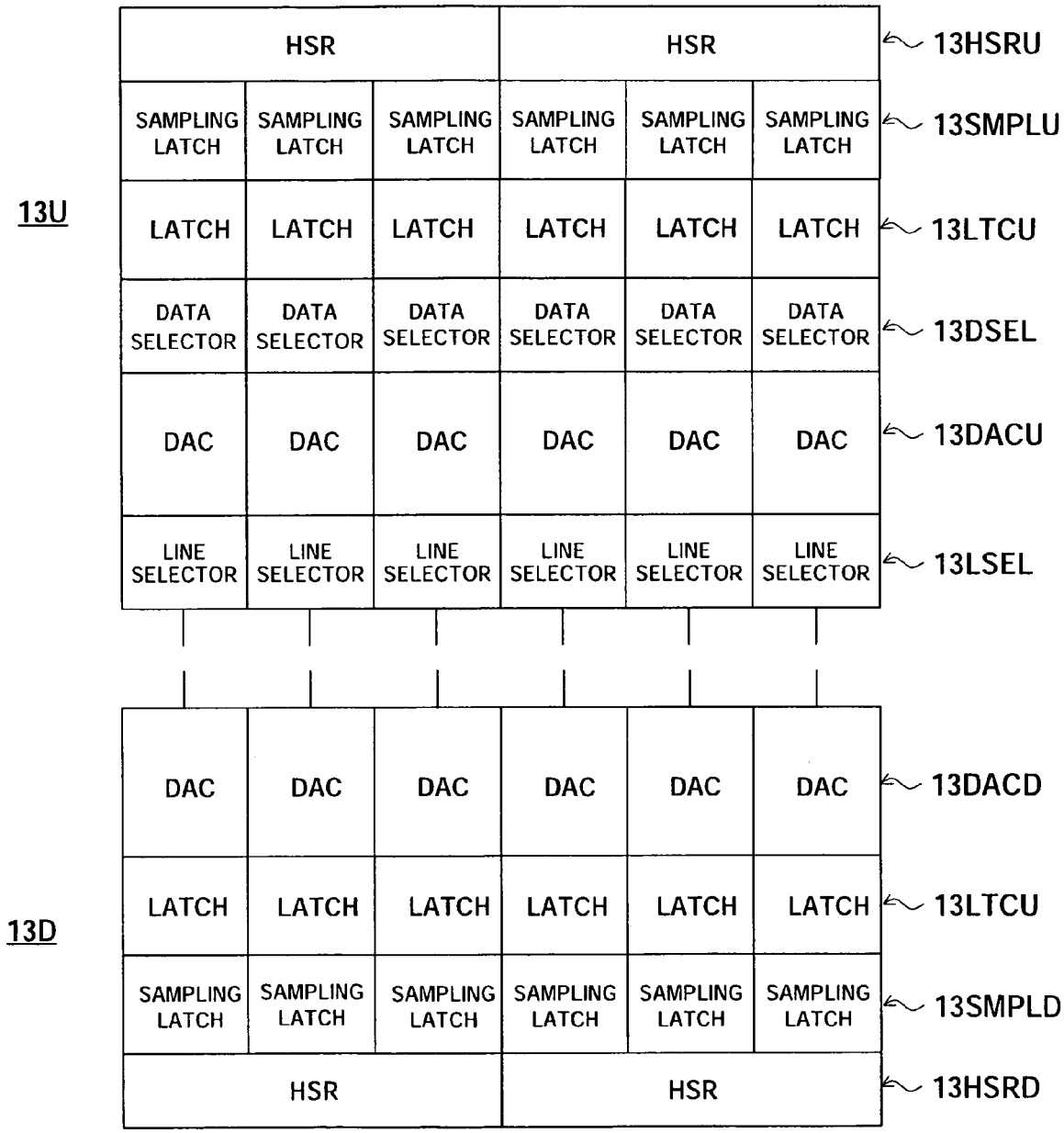
FIG. 5 is a block diagram showing an example of the basic configuration of a first horizontal drive circuit and a second horizontal drive circuit of the first embodiment.

FIG. 5 is a block diagram showing an example of the basic configuration of the first horizontal drive circuit 13U and the second horizontal drive circuit 13D of the present embodiment.

The first horizontal drive circuit 13U, as shown in FIG. 5, has a shift register (HSR) group 13HSRU, a sampling latch circuit group 13SMPLU, a second latch circuit (line sequence latch circuit) group 13LTCU, a data selector group 13DSEL, a DAC group DACU, and a line selector group 13LSEL. On the other hand, the second horizontal drive circuit 13D, as shown in FIG. 5, has a shift register (HSR) group 13HSRD, a sampling latch circuit group 13SMPLD, a second latch circuit (line sequence latch circuit) group 13LTCD, and a DAC group 13DACD.

Note that, in the present embodiment, the data input to the horizontal drive circuits 13U and 13D from the data processing circuit 16 are supplied at 0-3V (2.9V) levels. In the first horizontal drive circuit 13U, the shift register (HSR) group 13HSRU, the sampling latch circuit group 13SMPLU, the second latch circuit (line sequence latch circuit) group 13LTCU, and the data selector group 13DSEL are driven by a voltage of 0-3V (2.9V), a level shifter is arranged in the input stage of the DAC group 13DACU although not shown, and the level is raised up to for example −2.3V to 4.8V. In the same way as, in the second horizontal drive circuit 13D, the shift register (HSR) group 13HSRD, the sampling latch circuit group 13SMPLD, and the second latch circuit (line sequence latch circuit) group 13LTCD are driven by a voltage of 0-3V (2.9V), a level shifter is arranged in the input stage of the DAC group 13DACD although not shown, and the level is raised up to for example −2.3V to 4.8V.

Below, the configurations and the functions of the first horizontal drive circuit 13U and the second horizontal drive circuit 13D will be explained with reference to FIG. 6, FIG. 7, FIG. 8, and FIG. 9.

Figure 6:
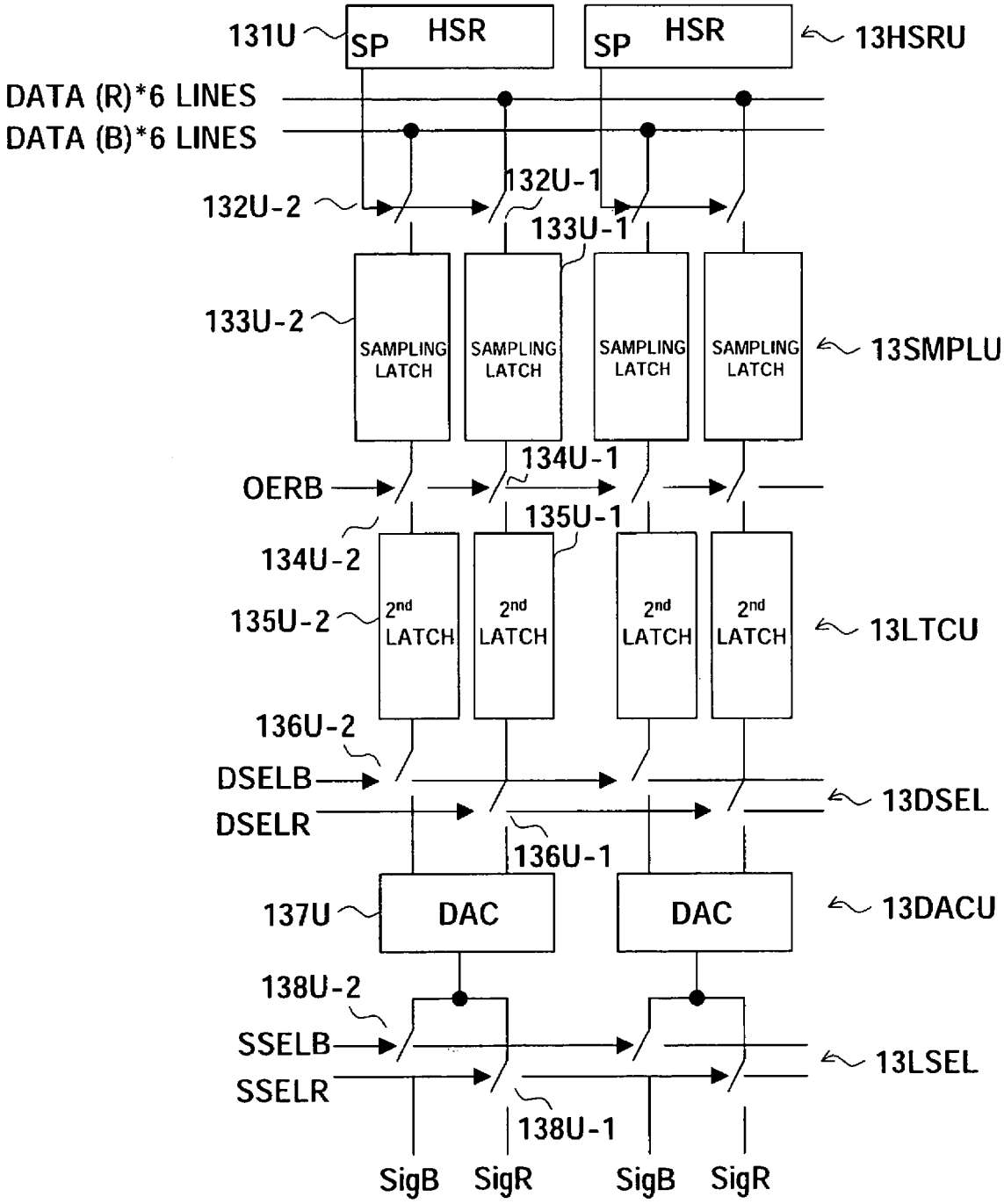
FIG. 6 is a circuit diagram showing a specific example of the configuration of the first horizontal drive circuit of FIG. 1.
Figure 7:
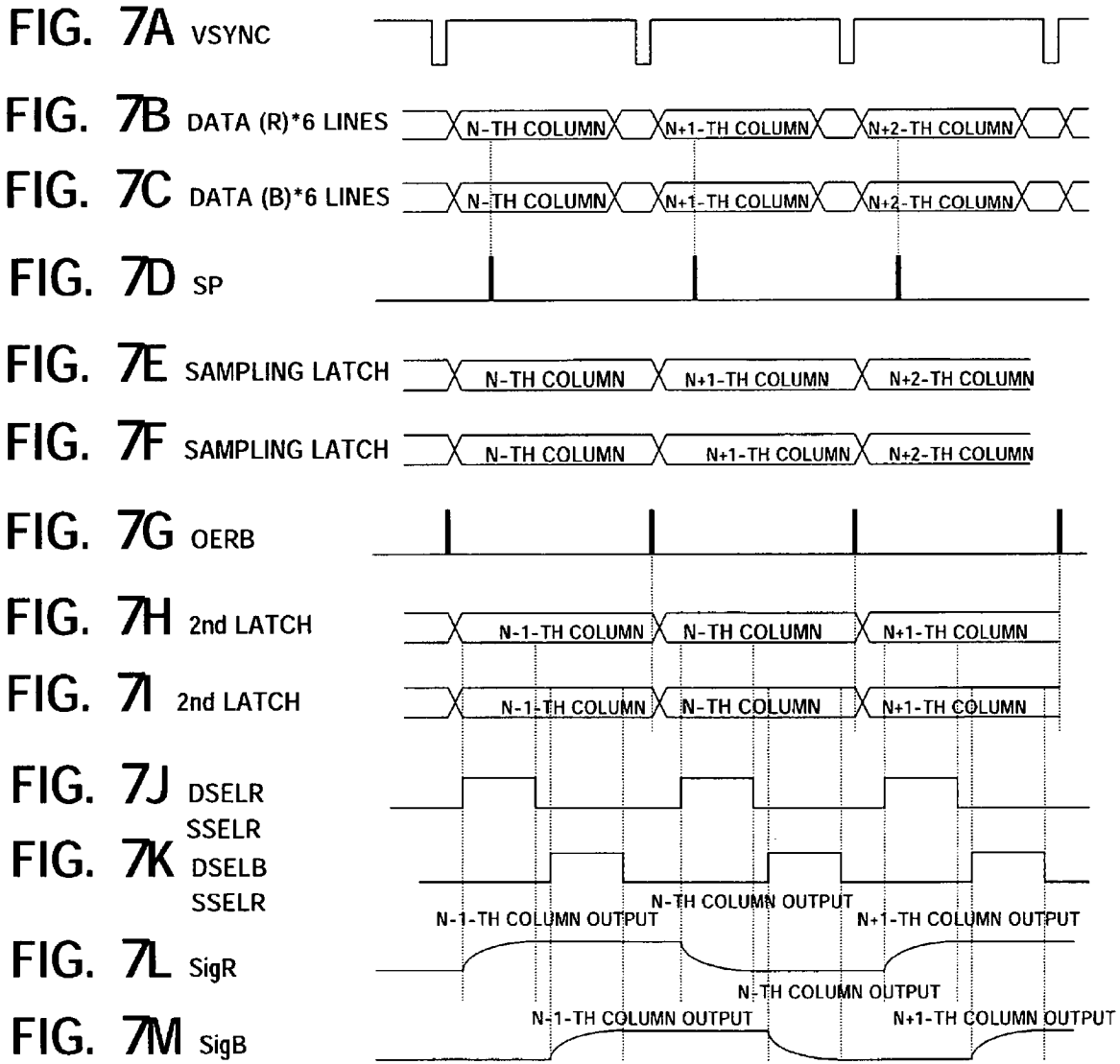
FIGS. 7A-7M illustrate a timing chart of the first horizontal drive circuit of FIG. 6.

First, the configuration and function of the first horizontal drive circuit 13U will be explained with reference to FIG. 6 and FIG. 7. FIG. 6 is a circuit diagram showing a specific example of the configuration of the first horizontal drive circuit 13U. Further, FIG. 7A to FIG. 7M are timing charts of the first horizontal drive circuit 13U.

The shift register group 13HSRU has a plurality of shift registers (HSR) 131U for sequentially outputting the shift pulses (sampling pulses) from transfer stages corresponding to the columns in synchronization with the horizontal transfer clock HCK (not shown).

The sampling latch circuit group 13SMPLU has two sampling switches 132U-1 and 132U-2 and sampling latch circuits 133U-1 and 133U-2 corresponding to the columns and sequentially samples and latches the digital image data, specifically the R data and B data in parallel, by the sampling pulse SP given from the corresponding shift register 131U. In the example of FIG. 6, the R data is latched by the sampling latch circuit 133U-1 through the sampling switch 132U-1, and the B data is latched by the sampling latch circuit 133U-2 through the sampling switch 132U-2.

The second latch circuit group 13LTCU has two sampling switches 134U-1 and 134U-2 and second latch circuits 135U-1 and 135U-2 corresponding to the columns, arranges the latch data of the sampling latch circuits 133U-1 and 133U-2 constituted by the R data and B data in line sequence by a pulse OERB, and latches the same by the second latch circuits 135U-1 and 135U-2. In the example of FIG. 6, the R data is latched by the second latch circuit 135U-1 through the sampling switch 134U-1, and the B data is latched by the second latch circuit 135U-2 through the sampling switch 134U-2.

The data selector group 13DSEL has two selection switches 136U-1 and 136U-2 corresponding to the columns, inputs the R data latched by the second latch circuit 135U-1 to the DAC in the same column of the DAC group 13DACU through the selection switch 136U-1 by the R data selection signal DSELR which is active and set at for example the high level in about ½ period of the former (first) half of one horizontal period (1 H), and inputs the B data latched by the second latch circuit 135U-2 to the DAC in the same column to which the R data was input in the former (first) half of 1 H by the B data selection signal DSELB which is active and set at the high level in the about ½ period of the latter half of 1 H.

The DAC group 13DACU has one for example 6-bit DAC (or 3-bit DAC or the like) 137U corresponding to each column, selects reference voltages V0 to V63 generated at the first reference voltage selection circuit 15U in accordance with values of 6 bits of the R data and B data selectively input by the selection switches 136U-1 and 136U-2, and outputs the analog R data and the analog B data to the selection switches of the same column of the line selector group 13LSEL.

The line selector group 13LSEL has two selection switches 138U-1 and 138U-2 corresponding to the columns, outputs the analog R data output from the corresponding DAC 137U to the corresponding data line through the selection switch 138U-1 by the analog R data selection signal SSELR which is active and set at for example the high level in about ½ period of the former (first) half of 1 horizontal period (1 H), and outputs the analog B data output from the corresponding DAC 137U to the data line of the same column through the selection switch 138U-2 by the analog B data selection signal SSELB which is active and set at the high level in about ½ period of the latter half of 1 H.

Figure 8:
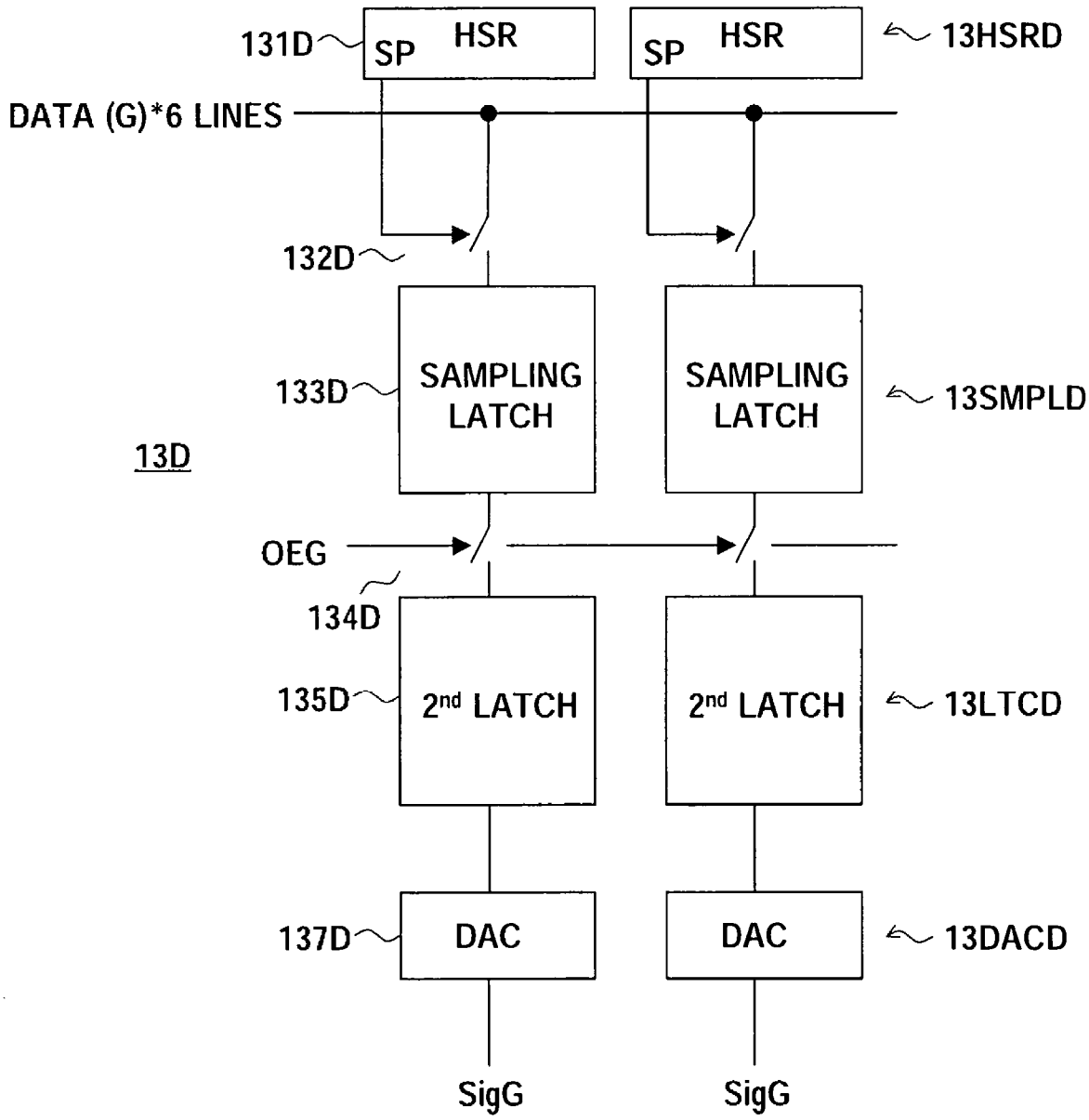
FIG. 8 is a circuit diagram showing a specific example of the configuration of the second horizontal drive circuit.
Figure 9:
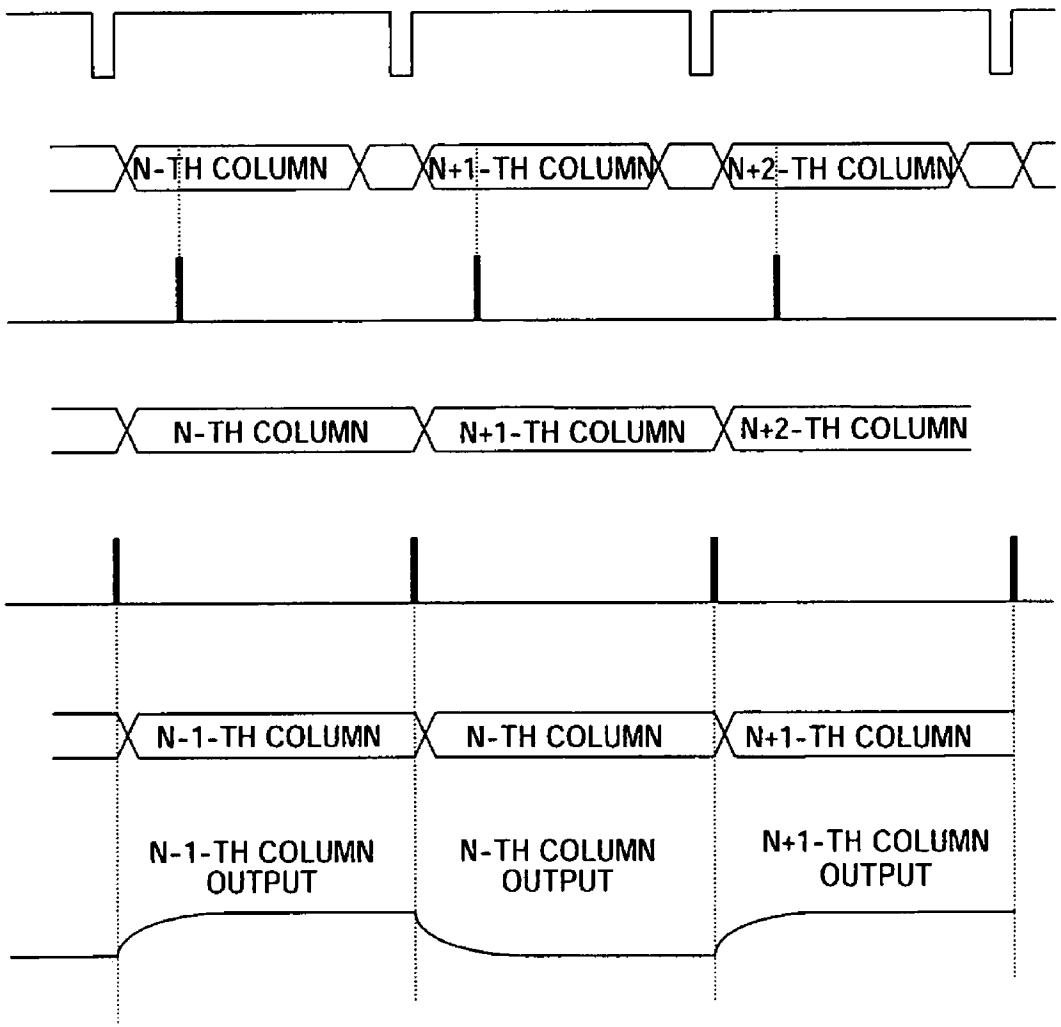
FIGS. 9A-9G illustrate a timing chart of the second horizontal drive circuit of FIG. 8.

Next, the configuration and function of the second horizontal drive circuit 13D will be explained with reference to FIG. 8 and FIG. 9. FIG. 8 is a circuit diagram showing a specific example of the configuration of the second horizontal drive circuit 13D. Further, FIG. 9A to FIG. 9G are timing charts of the second horizontal drive circuit 13D of FIG. 8.

The shift register group 13HSRD has a plurality of shift registers (HSR) 131D sequentially outputting shift pulses (sampling pulses) SP from transfer stages corresponding to columns in synchronization with a horizontal transfer clock HCK (not shown).

The sampling latch circuit group 13SMPLD has one sampling switch 132D and sampling latch circuit 133D corresponding to each column and sequentially samples and latches the digital image data, specifically the G data, by a sampling pulse SP given from the corresponding shift register 131D.

The second latch circuit group 13LTCD has one sampling switch 134D and second latch circuit 135D corresponding to each column, arranges latch data of the sampling latch circuit 133D constituted by the G data in line sequence by the pulse OEG, and latches the same by the second latch circuit 135D.

The DAC group 13DACD has one, for example, 6-bit DAC (or 3-bit DAC etc.) corresponding to each column, converts the G data latched by the second latch circuit 135D corresponding to the reference voltages V0 to V63 generated at the second reference voltage selection circuit 15D to analog data, and outputs the same to the data line of the same column.

The first reference voltage generation circuit 15U is a circuit accompanying the reference voltage selection type 6-bit DAC 137U, generates the number of gradations worth of reference voltages V0 to V63 corresponding to the number of bits of the input image data, and gives the same to the reference voltage selection type DAC 137U. The reference voltage generation circuit 15U divides the black signal use reference voltage V0 and the white signal use reference voltage V63 by resistance division to generate color signal use reference voltages V1 to V62.

The second reference voltage generation circuit 15D is a circuit accompanying the reference voltage selection type 6-bit DAC 137D, generates the number of gradations worth of reference voltages V0 to V63 corresponding to the number of bits of the input image data, and gives the same to the reference voltage selection type DAC 137D. The reference voltage generation circuit 15D divides the black signal use reference voltage V0 and the white signal use reference voltage V63 by resistance division to generate the color signal reference voltages V1 to V62.

The data processing circuit 16 performs phase adjustment and parallel conversion for lowering the frequency on the parallel digital data input from the outside, outputs the R data and the B data to the first horizontal drive circuit 13U, and outputs the G data to the second horizontal drive circuit 13D.

Next, the operation by the above configuration will be explained.

The parallel digital data input from the outside is adjusted in phase and parallel converted for lowering the frequency at the data processing circuit 16 on the glass substrate 11, the R data and the B data are output to the first horizontal drive circuit 13U, and the G data is output to the second horizontal drive circuit 13D. The second horizontal drive circuit 13D sequentially samples and holds the digital G data input from the data processing circuit 16 at the sampling latch circuit 133D over 1 H. Thereafter, the G data transferred to the second latch circuit 135D in the horizontal blanking period and converted to analog data at the DAC 137D in the next 1 H period is output to the data line. The first horizontal drive circuit 13U separately samples the R data and the B data over 1 H, holds them in the sampling latch circuits 133U-1 and 133U-2, and transfers the same to the second latch circuits 135U-1 and 135U-2 in the next horizontal blanking period. In the next 1 H period, by the data selector, the R data is output to the DAC 137U in ½ of the former (first) half of 1 H, and the B data is output to the DAC 137U in ½ of the latter half. The switching of the data lines output from the line selector for selecting the data lines is carried out corresponding to the input of the DAC 137U. Note that this can be realized even if the sequence of processing of G, R, and B is changed.

According to the present embodiment, the DAC outputs of the R data and the B data are serially processed and the number of circuits can be decreased, therefore the layout pitch able to be used in one circuit becomes 3/2 of the past one at the sampling latch circuit and the second latch circuit and DAC of the second horizontal drive circuit 13D for processing the G data and becomes 3/2 of it at the DAC in the first horizontal drive circuit 13U for processing the R data and the B data. Due to this, a narrower frame in the layout of the horizontal drive circuit portion can be realized. Further, the horizontal drive circuits are provided above and below the active display area 12 for each color, therefore, even when the first horizontal drive circuit 13U and the second horizontal drive circuit 13D separately have reference voltage generation circuits, the problem in image quality of the past art like vertical stripes will not occur. By separately providing the reference voltage generation circuits, it becomes unnecessary to connect the upper and lower horizontal drive circuits by a reference voltage line, therefore a narrower frame in the laterial direction can also be realized.

Note that, in the above explanation, the R data and the B data were rearranged by providing a line memory in the first horizontal drive circuit 13U, but it is also possible to rearrange the data outside of the horizontal drive circuit.

Figure 10:
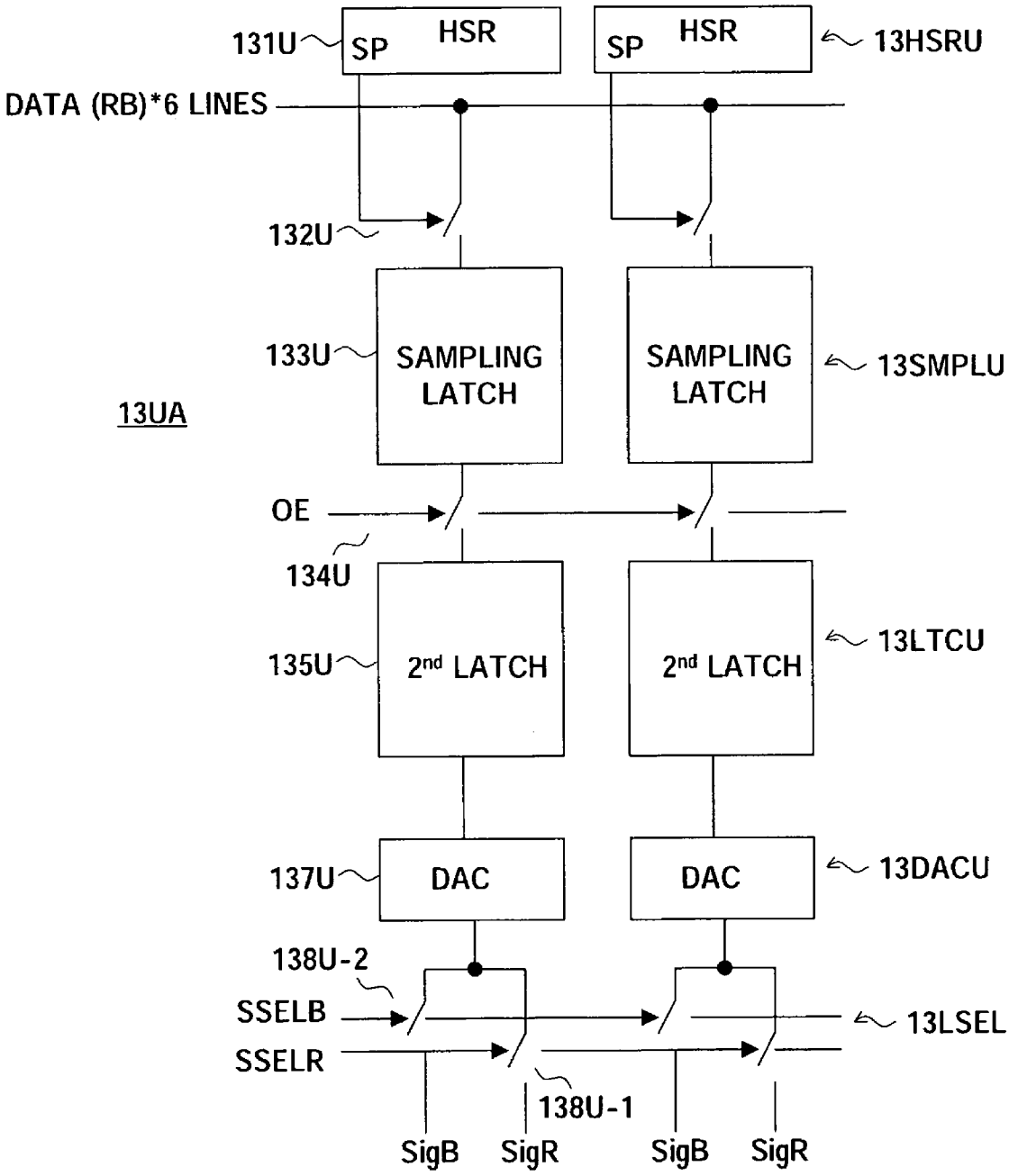
FIG. 10 is a circuit diagram showing an example of the configuration of the first horizontal drive circuit in a case where a data rearrangement circuit is provided at the outside.

FIG. 10 is a circuit diagram showing an example of the configuration of the first horizontal drive circuit in the case where the data rearrangement circuit is provided at the outside. Further, FIG. 11A to FIG. 11J are timing charts of a first horizontal drive circuit 13UA of FIG. 10.

The differences of the first horizontal drive circuit 13UA of FIG. 10 from the circuit of FIG. 6 are that the number of sampling switches provided corresponding to each column need not be two, but may be one as well and it is not necessary to provide the data selector.

Figure 12:
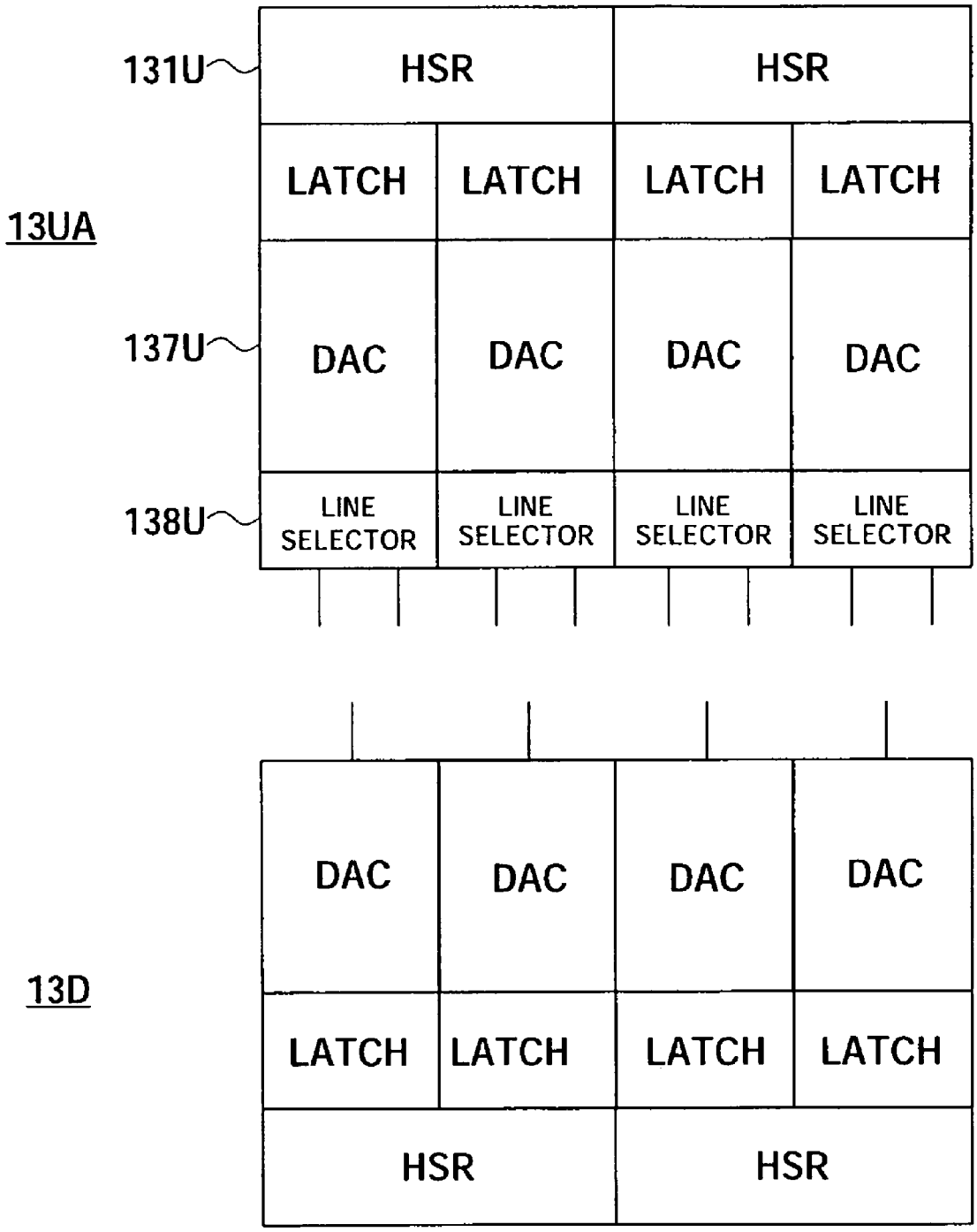
FIG. 12 is a diagram for explaining an effect of the circuit of FIG. 10.

By employing this system, serial processing of the sampling latch circuit and the second latch circuit in the first horizontal drive circuit 13UA becomes possible. Also the layout pitch able to be used in these circuits becomes 3/2 the past pitch. Due to this, as shown in FIG. 12, development of drive circuits of narrower pitch becomes possible and, at the same time, further narrower frames can be realized.

According to the present drive system, fabrication of an integral drive circuit type display element able to meet the demands for narrower frames and higher precision becomes possible.

Second Embodiment

Next, as a second embodiment, a more preferred configuration of the first horizontal drive circuit in the integral drive circuit type liquid crystal display device according to the present invention will be explained.

Figure 13:
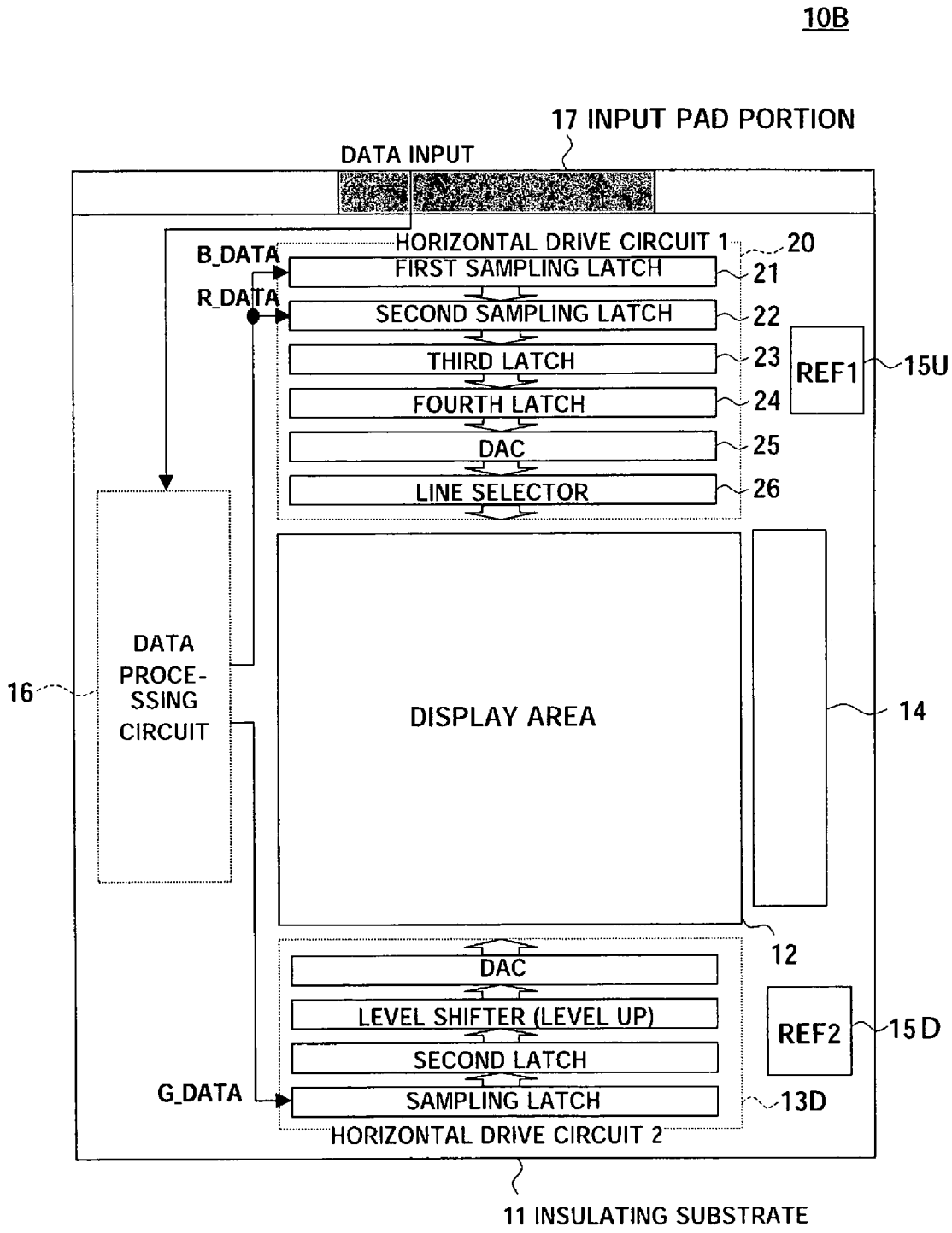
FIG. 13 is a block diagram showing the configuration of an integral drive circuit type liquid crystal display device according to a second embodiment.

FIG. 13 is a block diagram showing the configuration of the integral drive circuit type liquid crystal display device according to the second embodiment.

Note that, in the liquid crystal display device 10B of FIG. 13, for facilitating the understanding, the same components as those of the liquid crystal display device 10 according to the first embodiment are represented by the same notations. Note that, the second horizontal drive circuit 13D is described in configuration omitting the shift register and including a level shifter, but substantially has the same configuration and function as those of the circuit explained in the first embodiment. Below, only the configuration and function of the first horizontal drive circuit 20 will be explained.

The first horizontal drive circuit 20 of FIG. 13 basically has two sampling latch groups and two second latch circuit groups in the same way as the case of the first embodiment. In FIG. 13, the two sampling latch circuit groups are defined as the first sampling latch group 21 and the second sampling latch group 22, and the two second latch circuit groups are defined as the third latch group 23 and the fourth latch group 24. Further, as will be explained later, the third latch group 23 and the fourth latch group 24 include the function of the data selector, and the fourth latch group includes a level shift function. Further, although the shift register group is omitted, substantially, in the same way as the first embodiment, the shift register group is provided. Namely, the first horizontal drive circuit 20 has a not shown shift register group, first sampling latch group 21, second sampling latch group 22, third latch group 23, fourth latch group 24, DAC group 25, and line selector group 26. Note that, the output circuit group is configured by the third latch group 23 and the fourth latch group 24.

Figure 14:
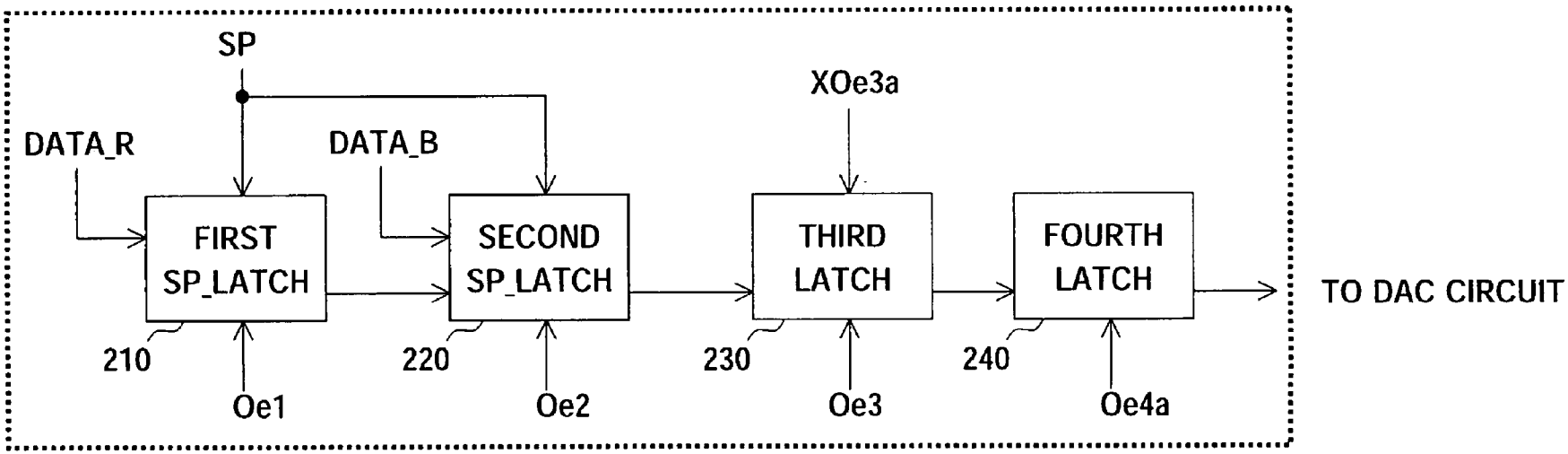
FIG. 14 is a block diagram showing a latch configuration of four stages arranged in columns in the first horizontal drive circuit according to the second embodiment.

FIG. 14 is a block diagram showing a four-stage latch configuration arranged in columns.

The circuit of FIG. 14 is configured by a first sampling latch 210 for latching the first digital R data by the sampling pulse SP from a not shown shift register, a second sampling latch 220 for latching the second digital B data by the same sampling pulse SP, a third latch 230 for transferring the digital R data and B data all together after that, and a fourth latch 240 for shifting the level of the transferred digital data and transferring the result to the DAC. Note that the output circuit is configured by the third latch 230 and the fourth latch 240.

In the first horizontal drive circuit 20, the shift register (HSR) group, the first sampling latch group 21, the second sampling latch group 22, and the third latch 23 perform the transfer and holding operation by the first power supply voltage VDD1 (VSS) of 0-3V (2.9V), and the fourth latch 24 changes the power supply voltage to the second power supply voltages VH and VL of for example −2.3V to 4.8V corresponding to the DAC of the next stage after the completion of the write operation into its own stage and performs the holding and signal data output operations.

Figure 15:
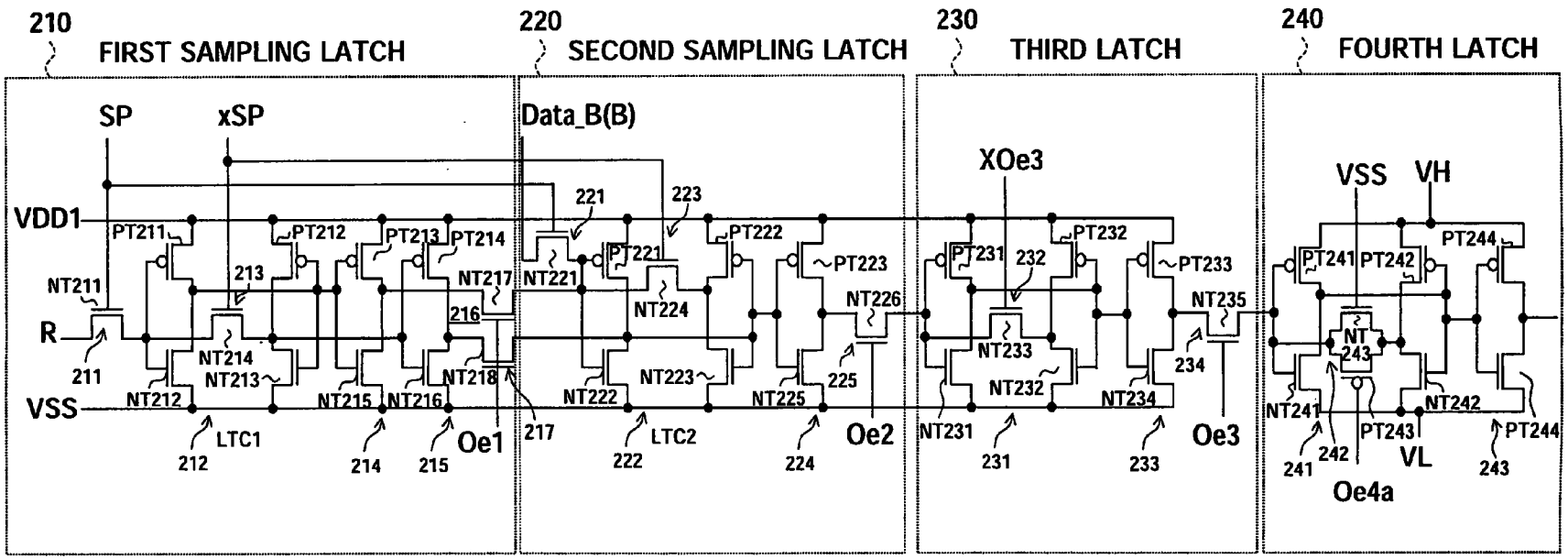
FIG. 15 is a circuit diagram showing a specific example of the configuration of the circuit of FIG. 14.

FIG. 15 is a circuit diagram showing a specific example of the configuration of the circuit of FIG. 14.

The first sampling latch 210 is configured by n channel transistors NT211 to NT218 and p channel transistors PT211 to PT214. The transistor NT211 forms the input transfer gate 211 of the R data having the gate supplied with the sampling pulse SP. The latch 212 is configured by cross connecting the inputs and outputs of the COMP inverters configured by the transistors PT211 and NT212 and PT212 and NT213. Further, the transistor NT214 has a gate supplied with an inverted signal XSP of the sampling pulse and forms an equalizer circuit 213 of the latch 212. An output buffer 214 formed by a CMOS inverter is configured by transistors PT213 and NT215. An output buffer 215 formed by the CMOS inverter is configured by transistors PT214 and NT216. The transistor NT217 has a gate supplied with a signal Oe1 and forms an output transfer gate 216 to the second sampling latch 220 of the output buffer 214, and the transistor NT218 has a gate supplied with the signal Oe1 and forms an output transfer gate 217 to the second sampling latch 220 of the output buffer 215.

The second sampling latch 220 is configured by n channel transistors NT221 to NT226 and p channel transistors PT221 to PT223. The transistor NT221 forms an input transfer gate 221 of the B data having a gate supplied with the sampling pulse SP. The latch 222 is configured by cross connecting the inputs and outputs of the COMP inverters configured by the transistors PT221 and NT222 and PT222 and NT223. Further, the transistor NT224 has a gate supplied with the inverted signal XSP of the sampling pulse and forms an equalizer circuit 223 of the latch 222. An output buffer 224 formed by the CMOS inverter is configured by transistors PT223 and NT225. The transistor NT226 has a gate supplied with a signal Oe2 and forms an output transfer gate 216 to the third latch 230 of the output buffer 224.

The third latch 230 is configured by n channel transistors NT231 to NT235 and p channel transistors PT231 to PT233. The latch 231 is configured by cross connecting the inputs and outputs of the COMP inverters configured by the transistors PT231 and NT231 and PT232 and NT232. Further, the transistor NT233 has a gate supplied with an inverted signal XOe3 of the signal Oe3 and forms an equalizer circuit 232 of the latch 231. An output buffer 233 formed by the CMOS inverter is configured by transistors PT233 and NT234. The transistor NT235 has a gate supplied with a signal Oe3 and forms an output transfer gate 234 to the fourth latch 240 of the output buffer 233.

The fourth latch 240 is configured by n channel transistors NT241 to NT244 and p channel transistors PT241 to PT244. The latch 241 is configured by cross connecting the inputs and outputs of the COMP inverters configured by the transistors PT241 and NT241 and PT242 and NT242. Further, the transistor NT243 has a gate supplied with the voltage VSS, while the transistor PT243 has a gate supplied with the signal Oe4*a*, whereby the equalizer circuit 242 of the latch 241 is formed. An output buffer 243 formed by the CMOS inverter is configured by the transistors PT244 and NT244. This fourth latch 240 operates when the second power supply voltages constituted by the voltages VH and VL are supplied.

In the circuit of FIG. 15, when sampling continuous image data, the image data (R data or B data) located in the first sampling latch 210 is stored in a CMOS latch cell 212. Simultaneously with that, the image data (B data and R data) different from that on the second sampling latch 220 is stored in the CMOS latch cell 222. When the storage of all data in 1 line of the horizontal direction into the first sampling latch 210 and the second sampling latch 220 is completed, the data of the CMOS latch cell 222 in the second sampling latch is transferred to the third latch 230 in the horizontal direction blanking period and immediately stored in the fourth latch 240. At this time, the CMOS latch 231 structure is cancelled so that the third latch 230 does not hold the data. When the transfer of the data in the second sampling latch 220 to the fourth latch 230 ends, next the data stored in the first sampling latch 210 is transferred to the second sampling latch 220 and quickly stored in the third latch 230. During the storage of the data in the next 1 line of the horizontal direction in the first sampling latch 210 and the second sampling latch 220, the first data stored in the fourth latch 240 is input to the DAC 25. When the transfer of the first data to the DAC ends, the second data stored in the third latch 230 is input to the DAC.

By using this sampling latch system to process two digital data by one sampling latch circuit, a reduction of size of the Hdot pitch can be realized and a higher resolution becomes possible by this.

In this way, the first horizontal drive circuit 20 according to the second embodiment, as shown in timing charts of FIG. 16A to FIG. 16M, stores the first data signal group (R data or B data) in the first latch group 21, stores the second data signal group (B data or R data) in the second latch group 22 by the same sampling pulse SP, and then first transfers the second data signal group to the fourth latch group 24, and next transfers the first data signal group to the third latch group 23. After the above operation, as shown in the timing charts of FIG. 17A to FIG. 17J, the second data signal group is transferred to the DAC in the former (first) half of the horizontal period, and next the first data signal is transferred from the third latch group 23 to the fourth latch group 24 after the end of the former (first) half of the horizontal period and transferred to the DAC in the latter half of the horizontal period. Namely, the DAC is used together (shared) by the first data signal group and the second data signal group. Then, as shown in FIG. 18A to FIG. 18K, signals are distributed to the data line corresponding to the first data signal and the data line corresponding to the second data signal in the active display area 12 via the data selector group in time sequence. Further, as shown in the timing charts of FIG. 19A to FIG. 19O, the first latch 210 to the third latch 230 perform the transfer and holding operations by the first power supply voltage VDD1 (VSS), and the fourth latch 240 changes the power supply voltage to the second voltages VH and VL corresponding to the DAC in the next stage after the completion of the write operation into their own stages and performs the holding and signal output operations.

Figure 20:
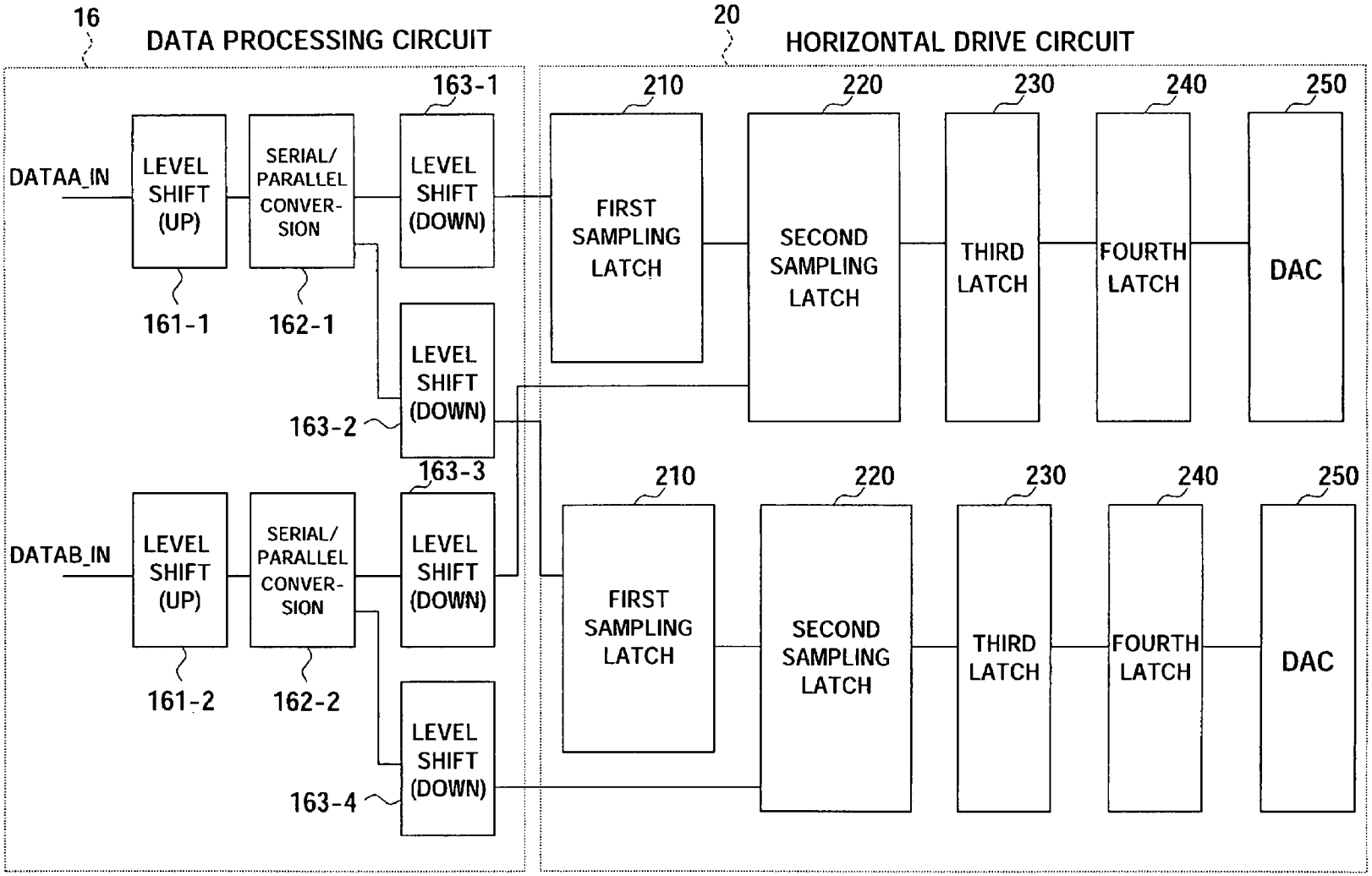
FIG. 20 is a diagram showing configurations of the first horizontal drive circuit and the data processing circuit of FIG. 14 in detail.

FIG. 20 is a diagram showing the configurations of the first horizontal drive circuit 20 and the data processing circuit 16 of FIG. 14 in more detail.

The data processing circuit 16 has level shifters 161-1 and 161-2 for shifting the levels of the input data R and B from 0-3V (2.9V) to 6V, serial/parallel conversion circuits 162-1 and 162-2 for converting the level shift R and B data from serial data to parallel data, and level shifters 163-1 to 163-4 for down shifting the parallel data from 6V to 0-3V (2.9V) and outputting the result to the horizontal drive circuit 20.

This circuit configuration reduces the number of sampling latch circuits required for sampling the data from the past method and contributes to the narrowering of the Hdot pitch. Further, by changing the general type sampling latch circuit to the sampling latch circuit of the new system, a reduction of the power consumption is made possible. Here, in the example of FIG. 20, a two-parallel configuration is employed in the data processing system, but more than a two-parallel configuration is also possible. In that case, the horizontal drive circuit corresponds to the parallel number and the number of blocks is according to the parallel number.

In the past system, the horizontal drive circuit needs Hdot number×RGB sampling latch circuits. Three image data worth of sampling latch circuits must be arranged in a Hdot pitch width. This obstructs the narrowering of the pitch. Contrary to this, according to the integral drive circuit type display device 10B of the second embodiment, two image data (for example R and B) are driven by one sampling latch circuit, therefore one sampling latch circuit may be arranged in a Hdot pitch if arranged above (or beneath) the display area. At this time, the second horizontal drive circuit for sampling the other G data is arranged at the opposite side, therefore a higher resolution can be realized. Further, the number of sampling circuits can be reduced from that in the past circuit, therefore the power consumption can be kept down. In the example of FIG. 13, the R data and the B data are input to the sampling latch circuit of the present invention, but any two data among R, G, and B may be input as well.

Namely, according to the second embodiment, a circuit transferring two digital data to a DAC by one sampling latch circuit can be realized on the insulating substrate and therefore an integral drive circuit type display device can be realized. Further, a low power consumption sampling latch circuit and integral drive circuit type display device can be realized.

Third Embodiment

In the first and second embodiments, only the normal mode was explained. In the third embodiment, the explanation will be given of an example of a configuration in which, in addition to the normal mode, at the time of setting of low gradation mode (8 color mode) having a smaller number of gradations than that in the normal mode, only the circuit portion corresponding to the number of gradations in the horizontal drive circuits is made active. The remaining circuit portion becomes non-active. That circuit portion does not consume power. Therefore, the power consumption can be reduced by that amount.

Figure 21:
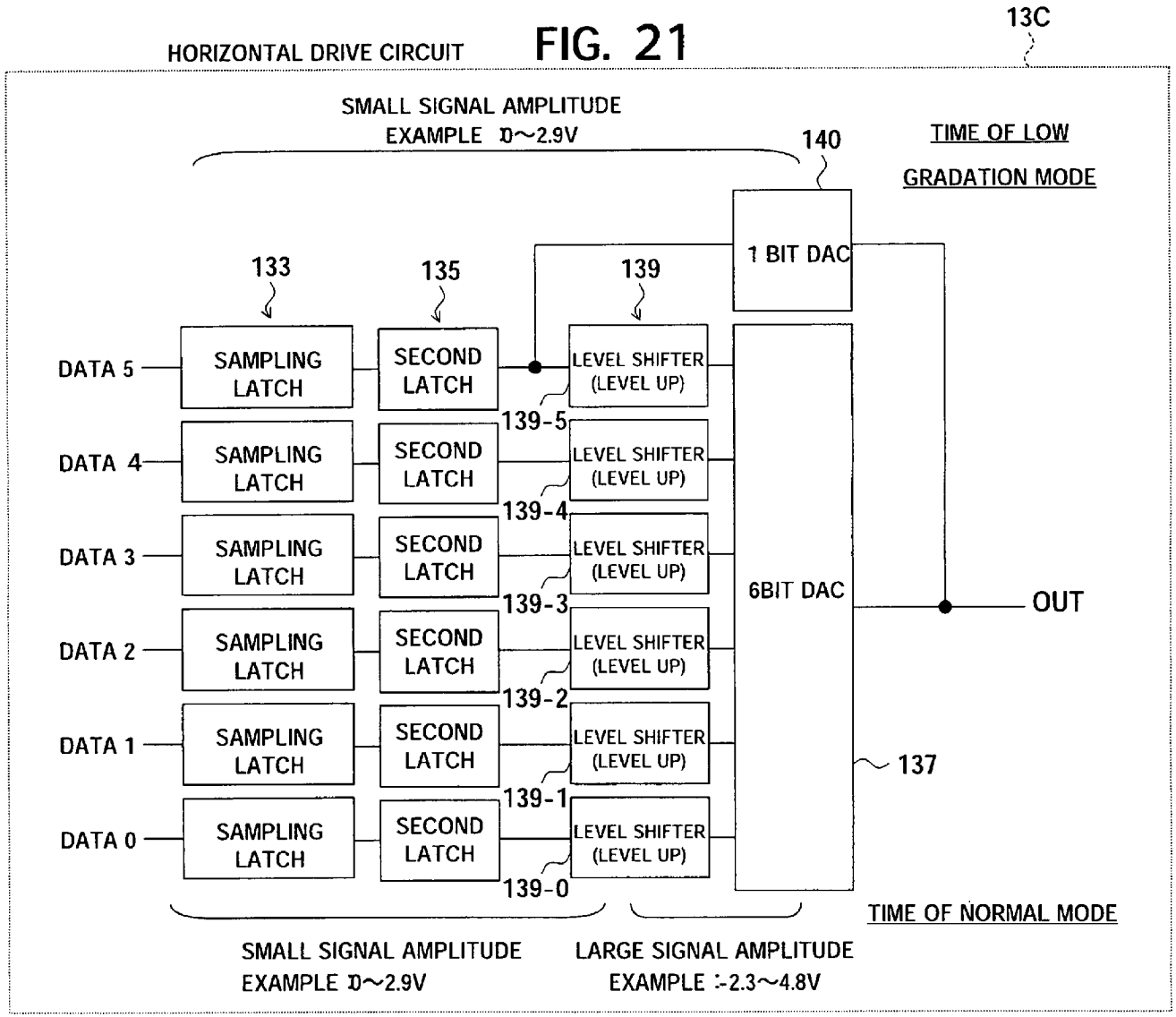
FIG. 21 is a block diagram showing the configuration of a principal part of the horizontal drive circuit according to the present third embodiment.

FIG. 21 is a block diagram showing the configuration of principal parts of a horizontal drive circuit 13C according to the third embodiment. In FIG. 21, for facilitating understanding, the same components as those of FIG. 6, FIG. 8, and FIG. 10 are represented by the same notations. Further, in FIG. 21, a level shifter 139 is arranged in front of the 6-bit DAC 137, and a 1-bit DAC 140 is provided parallel to the 6-bit DAC. Then, as already explained in the first and second embodiments, up to the front of the level shifter 140, a small signal amplitude 0-3V (2.9V) is used for driving the display. In the third embodiment, however, the bit data d5 among the 6 bits raised in level by the level shift by the level shifter 139 is not input to the 1 bit DAC 140. Instead, the data bit d5 of this small amplitude 0-3V (2.9V) is input.

Namely, the horizontal drive circuit 13 of the third embodiment independently has an n-bit (n=6 bits in this example) DAC 137 used in the normal mode and a k-bit (k=1 bit in this example) DAC 140 having n data signal lines for controlling that and able to be controlled by using k (n>k) data signal lines among n data signal lines. Which of the n-bit DAC and the k-bit DAC is to be used is controlled by the mode selection signal. The n-bit DAC is used in the normal mode, during which the level is converted to a voltage amplitude (V2) larger than the small signal amplitude (V1) and input to the n bit DAC circuit. At the time of the low gradation mode having a smaller number of gradations than that in the normal mode (at the time of an 8 color mode), the k-bit DAC 140 is used. That data is input to the k-bit DAC circuit while keeping the small signal amplitude (V1) as it is.

In the horizontal drive circuit 13C, in the normal mode, data having a small signal amplitude (V1) is passed through the level shifter 139 and raised in level to a voltage amplitude (V2) required for switching of the 6-bit DAC 137 and then is output to the 6-bit DAC 137 path. At this time, the 1-bit DAC 140 for the low gradation mode is stopped by the mode selection signal. At the time of the low gradation mode, an MSB line (d5 out) is used while keeping the small signal amplitude (V1) voltage as it is and the data is output to the 1-bit DAC 140. At this time, the 6-bit DAC circuit 137 for the normal mode is stopped by the mode selection signal. In this circuit configuration, it becomes unnecessary to raise the level and raise the voltage high at the time of the low gradation mode, so the power consumption can be greatly reduced.

In the circuit of FIG. 21, the data signal of the small signal amplitude (V1) is sequentially sampled at the sampling latch 133 corresponding to the display line position of the display device and then transferred to the second latch 135 all together. Then, the data is output from the second latch 135 to the DAC all together. In this circuit configuration, it becomes unnecessary to raise the level and raise the voltage high at the time of the low gradation mode, so the power consumption can be greatly reduced. In the example of FIG. 21, there are two latches, that is, the sampling latch and the second latch, but there may be more than two latches as well like in the second embodiment.

Figure 22:
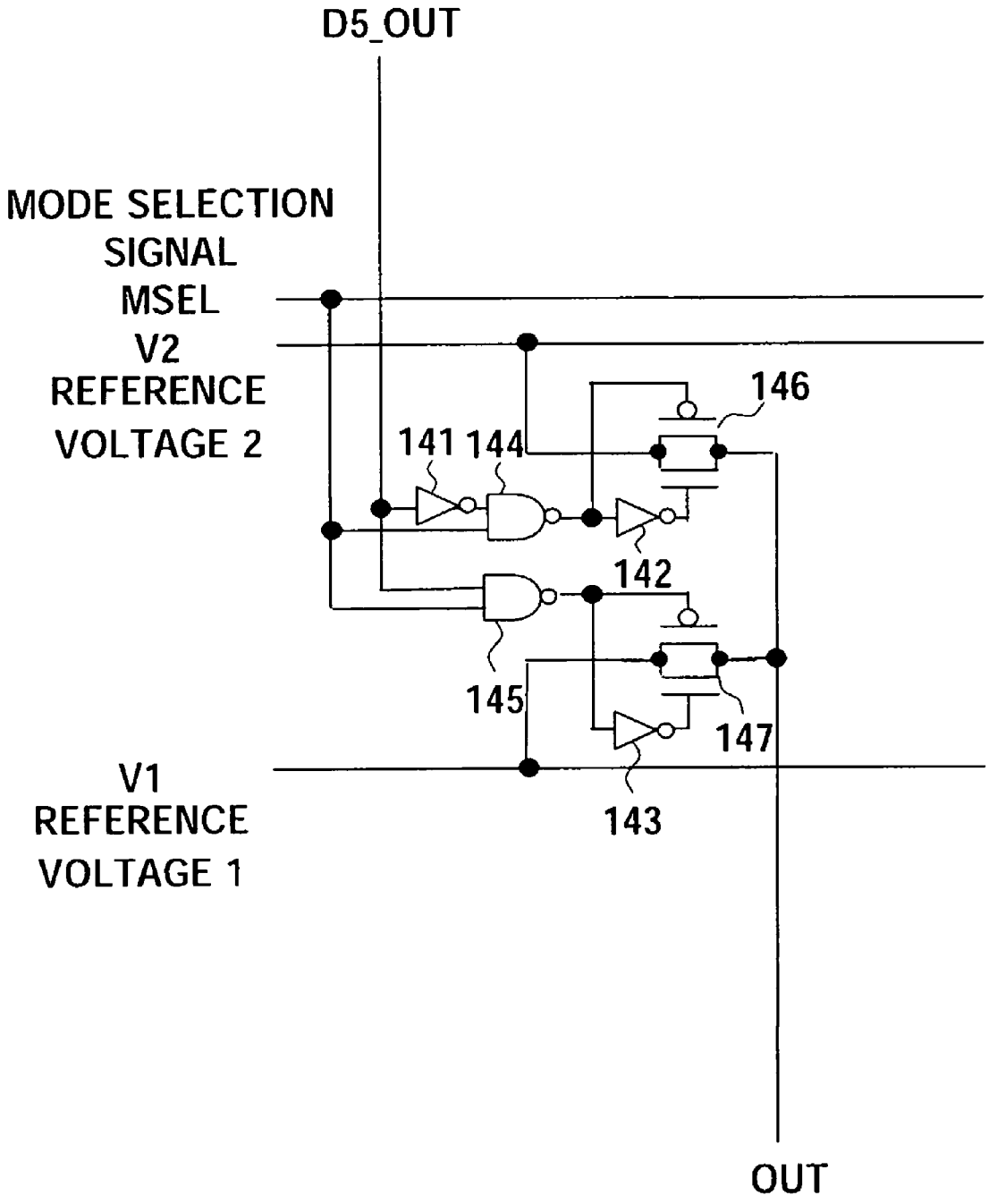
FIG. 22 is a circuit diagram showing a specific example of the configuration of a DAC for a low gradation mode.

FIG. 22 is a circuit diagram showing a specific example of the configuration of the DAC 140 for the time of the low gradation mode.

This DAC 140 has inverters 141, 142, and 143, 2-input AND gates 144 and 145, and transfer gates 146 and 147 connecting sources and drains of the n channel and p channel transistors.

An input terminal of the inverter 141 is connected to an output line of the bit data d5 of the second latch 139-5, and the output terminal is connected to one input terminal of a NAND gate. The other input terminal of the NAND gate 144 is connected to a supply line of the mode selection signal MSEL, and the output terminal of the NAND gate 144 is connected to the input terminal of the inverter 142 and the gate of the p channel transistor of the transfer gate 146. The output terminal of the inverter 142 is connected to the gate of the n channel transistor of the transfer gate 146. One input terminal of the NAND gate 145 is connected to the output line of the bit data d5, and the other input terminal is connected to the supply line of the mode selection signal MSEL. The output terminal of the NAND gate 145 is connected to the input terminal of the inverter 143 and the gate of the p channel transistor of the transfer gate 147, and the output terminal of the inverter 143 is connected to the gate of the n channel transistor of the transfer gate 147.

In the DAC 140 of FIG. 22, the normal mode or the low gradation mode is selected by the mode selection signal MSEL, and the reference voltage V1 or the reference voltage V2 is selected according to the value of the input of an MSB line d5_out of the signal amplitude (V1) at the time of the low gradation mode. For this reason, a low gradation DAC circuit performing high speed processing while keeping the small signal amplitude (V) as it is can be realized.

According to the third embodiment, a low power consumption DAC circuit and integral drive circuit type display device able to perform processing at a high speed can be realized. Further, upper bit and lower bit level shifters need not be separately provided, therefore a narrower frame can be realized.

Note that, in the above embodiments, the explanation was given by taking as an example a case where the present invention was applied to an active matrix type liquid crystal display device, but the invention not limited to this. The present invention can also be applied to other active matrix type display devices such as EL display devices using electroluminescence (EL) elements as electro-optical elements of the pixels.

Further, in the above embodiments, the explanation was given by taking as an example the 1 bit mode (2 gradation mode) as one of the power saving modes, that is, the low gradation mode, but the present invention is not limited to this. A reduction of the power consumption can be achieved so long as the mode is one of a smaller number of gradations than that of the normal mode.

Active matrix type display devices such as active matrix type liquid crystal display devices according to the above embodiments may be used not only as displays of office equipment such as personal computers and word processors and of television receivers, but also as the display areas of mobile phones, PDAs, and other mobile terminals which are now being made increasingly smaller in size and compact.

Figure 23:
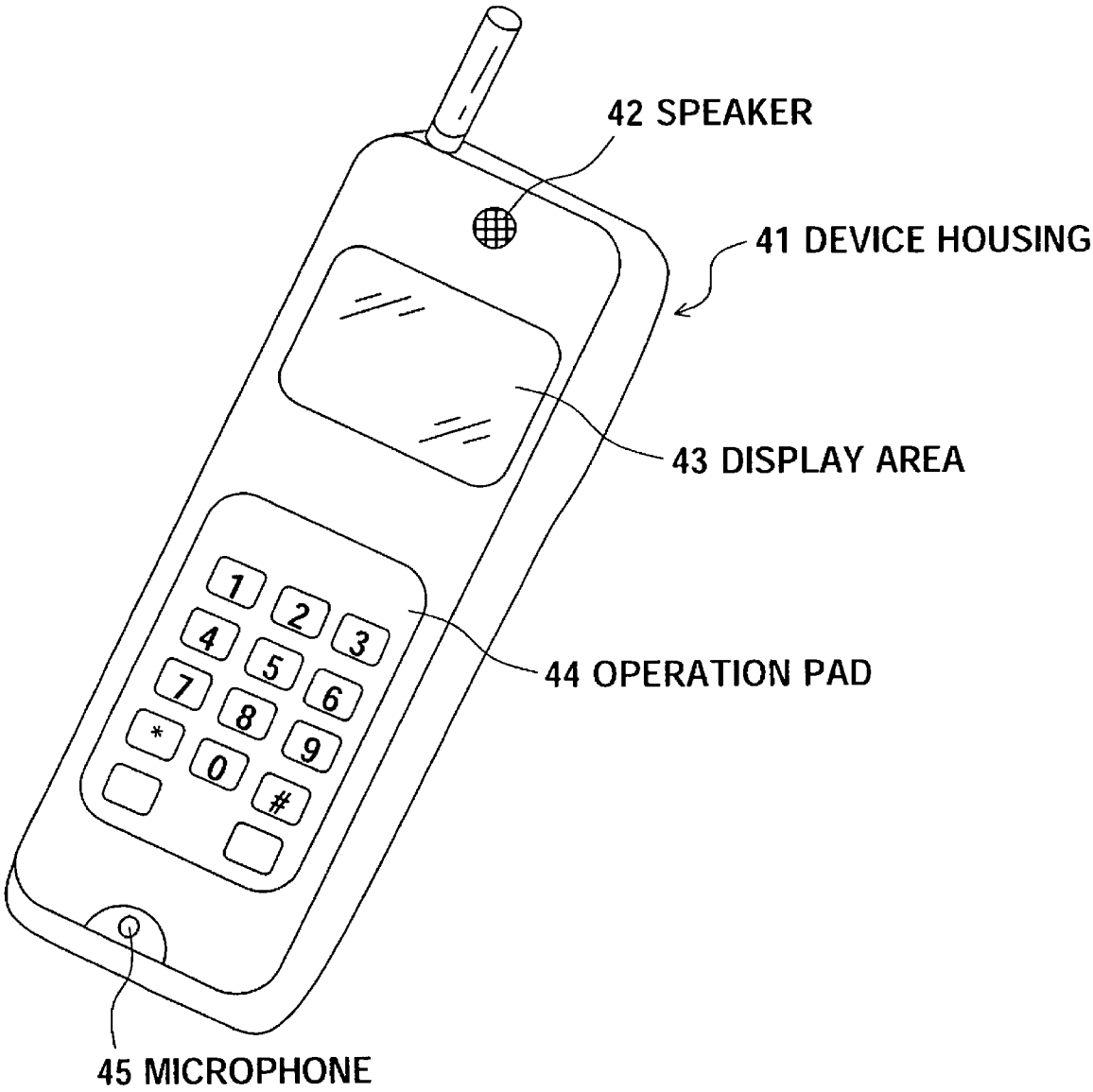
FIG. 23 is a schematic view of the outer appearance showing the configuration of a mobile terminal according to the present embodiment as constituted by a mobile phone.

FIG. 23 is a view of the appearance of a mobile terminal to which the embodiments of the present invention is applied, for example, a mobile phone.

The mobile phone according to this example is comprised of a speaker 42, a display area 43, an operation pad 44, and a microphone 45 sequentially arranged from the top on the front of a device housing 41. In a mobile phone having such a configuration, for the display area 43, for example a liquid crystal display device is used. As this liquid crystal display device, use is made of an active matrix type liquid crystal display device according to the embodiments explained above.

In this way, in a mobile terminal such as a mobile phone, by using a previously explained active matrix type liquid crystal display device according to the above embodiments as the display area 43, in each circuit mounted in this liquid crystal display device, narrowering of the pitch is possible and narrowering of the frame can be realized. Further, the power consumption can be reliably reduced at the time of the low gradation mode, one of the power saving modes. Therefore, a reduction of the power consumption of the display device can be achieved, and accordingly a reduction of the power consumption of the terminal becomes possible.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A display device comprising:

a display area having pixels arranged in a matrix;

a vertical drive circuit configure to select pixels in the display area in unit of rows;

a first horizontal drive circuit:

(a) receiving as input first and second digital image data corresponding only to different first and second colors respectively;

(b) converting the digital image data to analog image signals; and (c) supplying the same to a data line to which pixels of the row selected by the vertical drive circuit are connected;

a second horizontal drive circuit:

(a) receiving as input a third digital image data corresponding only to a third color different from the first and second colors;

(b) converting the digital image data to an analog image signal; and (c) supplying the same to a data line to which pixels of the row selected by the vertical drive circuit are connected;

a first reference voltage generation circuit operably connected to the first horizontal drive circuit; and a second reference voltage generation circuit operably connected to the second horizontal drive circuit, said second reference voltage generation circuit being separate from the first reference voltage generation circuit;

the first horizontal drive circuit including:

(a) a first sampling latch configured to sequentially sample and latch the first digital image data using a first sampling pulse;

(b) a second sampling latch cascade connected to the first sampling latch, the second sampling latch having an output, the second sampling latch being configured to sequentially sample and latch the second digital image data using said first sampling pulse;

(c) an output circuit including a third latch and a fourth latch cascade connected to said output of said second sampling latch, the output circuit being configured to select and output the first and second digital image data latched in the first and second sampling latches in a time division manner in a predetermined period, wherein the output circuit:

(i) transfers the second digital image data of the second sampling latch through the third latch to the fourth latch;

(ii) after transferring the second digital image data to the fourth latch, transfers the first digital image data of the first sampling latch through the second sampling latch to the third latch; and (iii) after transferring the first digital image data to the third latch, transfers the second digital image data from the fourth latch to a digital/analog converter;

(d) the digital/analog converter configured to convert the first and second digital image data output from the output circuit to analog image signals; and (e) a line selector configured to:

(i)select the first and second digital image data converted to analog data by the digital/analog converter in a time division manner in the predetermined period, in an alternating fashion, including only selecting the first digital image data corresponding only to the first color and the second digital image data corresponding only to the second color; and (ii) output the same to a data line.

2. The display device of claim 1, wherein the output circuit is configured to:

(a) transfer the second digital image data to the digital/analog converter in the former half of a horizontal period after the above operation;

(b) thereafter, transfer the first digital image data from the third latch to the fourth latch after the end of the former half of the horizontal period; and (c) transfer the same to the digital/analog converter in the latter half period of the horizontal period.

3. The display device of claim 2, wherein the first sampling latch, the second sampling latch, and the third latch perform the transfer and holding operations by a first power supply voltage, and the fourth latch changes the power supply voltage to a second voltage corresponding to the digital/analog converter in the next stage and performs the holding and signal output operations after completion of a write operation into the itself.

4. The display device of claim 1, wherein the first sampling latch, the second sampling latch, and the third latch perform the transfer and holding operations by a first power supply voltage, and the fourth latch changes the power supply voltage to a second voltage corresponding to the digital/analog converter in the next stage and performs the holding and signal output operations after completion of a write operation into the itself.

5. The display device of claim 1, wherein:

(a) the second horizontal drive circuit includes:

(i) a sampling latch circuit for sequentially sampling and latching third digital image data;

(ii) a second latch circuit for latching the latch data of the sampling latch circuit again;

(iii) a digital/analog converter for converting the digital image data latched by the second latch circuit to an analog image signal; and (iv) digital/analog converters of the first and second horizontal drive circuits include reference voltage selection type digital/analog converters;

(b) the first reference voltage generation circuit is configured to:

(i) generate a plurality of reference voltages; and (ii) supply the same to the digital/analog converter of the first horizontal drive circuit; and (c) the second reference voltage generation circuit is configured to:

(i) generate a plurality of reference voltages; and (ii) supply the same to the digital/analog converter of the second horizontal drive circuit.

6. The display device of claim 5, wherein at least the first and second horizontal drive circuits and the first and second reference voltage generation circuits are formed integrally with the active pixel area on the same substrate.

7. The display device of claim 5, wherein the first and second horizontal drive circuits have n-bit digital/analog converters used in the normal mode and n data signal lines for controlling them and independently have k-bit digital/analog converters able to use and control k (n >k) data signal lines among n data signal lines, which of the n-bit digital/analog converter or the k-bit digital/analog converter is to be used is controlled by a mode selection signal, and control is performed so that in the normal mode, the n-bit digital/analog converter is used and the level is converted to a second power supply voltage system having a larger voltage amplitude than a first power supply voltage system having a small signal amplitude and input to the n-bit digital/analog converter circuit and so that at the time of a low gradation mode having a smaller number of gradations than that in the normal mode, the k-bit digital/analog converter is used and a signal having the small signal amplitude is input to the k-bit digital/analog converter circuit as it is.

8. The display device of claim 1, wherein at least the first and second horizontal drive circuits are formed integrally with an active pixel area on the same substrate.

9. The display device of claim 1, wherein the first sampling pulse is supplied to the first sampling latch and the second sampling latch without being supplied to the third latch and the fourth latch.

10. A mobile terminal having a display device, the display device comprising:

a display area having pixels arranged in a matrix;

a vertical drive circuit configured to select pixels in the display area in unit of rows;

a first horizontal drive circuit:

(a) receiving as input first and second digital image data corresponding only to different first and second colors respectively;

(b) converting the digital image data to analog image signals; and (c) supplying the same to a data line to which pixels of the row selected by the vertical drive circuit are connected;

a second horizontal drive circuit:

(a) receiving as input a third digital image data corresponding only to a third color different from the first and second colors;

(b) converting the digital image data to an analog image signal; and (c) supplying the same to a data line to which pixels of the row selected by the vertical drive circuit are connected;

a first reference voltage generation circuit operably connected to the first horizontal drive circuit; and a second reference voltage generation circuit operably connected to the second horizontal drive circuit, said second reference voltage generation circuit being separate from the first reference voltage generation circuit;

the first horizontal drive circuit including:

(a) a first sampling latch configured to sequentially sample and latch the first digital image data using a first sampling pulse;

(b) a second sampling latch cascade connected to the first sampling latch, the second sampling latch having an output, the second sampling latch being configured to sequentially sample and latch the second digital image data using said first sampling pulse;

(c) an output circuit including a third latch and a fourth latch cascade connected to said output of said second sampling latch, the output circuit being configured to select and output the first and second digital image data latched in the first and second sampling latches in a time division manner in a predetermined period, wherein the output circuit:

(i) transfers the second digital image data of the second sampling latch through the third latch to the fourth latch;

(ii) after transferring the second digital image data to the fourth latch, transfers the first digital image data of the first sampling latch through the second sampling latch to the third latch; and (iii) after transferring the first digital image data to the third latch, transfers the second digital image data from the fourth latch to a digital/analog converter;

(d) the digital/analog converter configured to convert the first and second digital image data output from the output circuit to analog image signals; and (e) a line selector configured to:

(i) select the first and second digital image data converted to analog data by the digital/analog converter in a time division manner in a predetermined period, in an alternating fashion, including only selecting the first digital image data corresponding only to the first color and the second digital image data corresponding only to the second color; and (ii) output the same to the data line.

* * * * *